US011982095B1

(12) United States Patent
Wolf et al.

(10) Patent No.: US 11,982,095 B1
(45) Date of Patent: May 14, 2024

(54) CANOPY WITH DEPLOYABLE STRUCTURE

(71) Applicant: Rivian IP Holdings, LLC, Plymouth, MI (US)

(72) Inventors: Philipp Josef Wolf, Dana Point, CA (US); Raghav Jaswal, Coventry (GB); Mark Andrew Jones, Shoreham-by-Sea (GB)

(73) Assignee: Rivian IP Holdings, LLC, Irvine, CA (US)

( * ) Notice: Subject to any disclaimer, the term of this patent is extended or adjusted under 35 U.S.C. 154(b) by 0 days.

(21) Appl. No.: 18/176,116

(22) Filed: Feb. 28, 2023

(51) Int. Cl.
*E04H 15/20* (2006.01)
*E04H 15/06* (2006.01)

(52) U.S. Cl.
CPC ..... *E04H 15/20* (2013.01); *E04H 15/06* (2013.01); *E04H 2015/201* (2013.01); *E04H 2015/206* (2013.01)

(58) Field of Classification Search
CPC ..... E04H 15/08
See application file for complete search history.

(56) References Cited

U.S. PATENT DOCUMENTS 4,562,849 A * 1/1986 Sirota ..... A45B 25/143 135/22
5,381,814 A * 1/1995 Brandon ..... B60P 3/343 160/68
6,568,737 B1 * 5/2003 Li ..... B60J 11/00 160/370.21
6,916,043 B2 * 7/2005 Rhea ..... B60J 11/00 280/848
7,562,928 B1 * 7/2009 Morazan ..... B60J 11/00 296/136.12
10,501,958 B2 * 12/2019 Veracini ..... E04H 15/54
10,654,350 B1 * 5/2020 Lovisetto ..... B60J 11/04
11,440,389 B2 * 9/2022 Powell ..... B60J 11/04
2006/0214465 A1 * 9/2006 Chau ..... B60J 11/00 296/136.1
2016/0338457 A1 * 11/2016 Gharabegian ..... G01J 1/42
2018/0186433 A1 * 7/2018 Gharabegian ..... A45B 25/165
2019/0225135 A1 * 7/2019 Dorn ..... B60P 3/341
2019/0352923 A1 * 11/2019 Harrison ..... B60P 3/341
2020/0398637 A1 * 12/2020 Chang ..... G08B 21/02

FOREIGN PATENT DOCUMENTS

WO WO-2022/177086 8/2022

OTHER PUBLICATIONS

Carthrottle, "Automatic Vehicle Canopy", https://www.carthrottle.com/post/0tyLD2/.

* cited by examiner

*Primary Examiner* — Noah Chandler Hawk
(74) *Attorney, Agent, or Firm* — Foley & Lardner LLP

(57) ABSTRACT

A canopy with a deployable structure is provided. An apparatus can include a canopy that includes a structure. The structure can be deployed over at least one portion of an object. The apparatus can include a fabric that is coupled to the structure. The structure can deploy the fabric over the at least one portion of the object.

20 Claims, 11 Drawing Sheets

CANOPY WITH DEPLOYABLE STRUCTURE

INTRODUCTION

A cover can protect a vehicle. However, it can be challenging to store and extend such a cover.

SUMMARY

An aspect of this disclosure can be directed to a canopy. The canopy can include a structure. The structure can be deployed over at least one portion of an object. The apparatus can include a fabric that is coupled to the structure. The structure can deploy the fabric over the at least one portion of the object.

An aspect of this disclosure can be directed to a system. The system can include a container that can couple to a vehicle. The container can store a canopy. The canopy can include a fabric and a deployable structure coupled to the fabric. The container can open to deploy the canopy over at least a portion of the vehicle. The deployable structure can extend the fabric over the at least the portion of the vehicle to deploy the canopy.

An aspect of this disclosure can be directed to a method. The method can include deploying a canopy over at least one portion of an object. The canopy can include a structure that can extend a fabric coupled to the structure over the at least one portion of the object.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification. The foregoing information and the following detailed description and drawings include illustrative examples and should not be considered as limiting.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. In the drawings.

DETAILED DESCRIPTION

Figure 1:
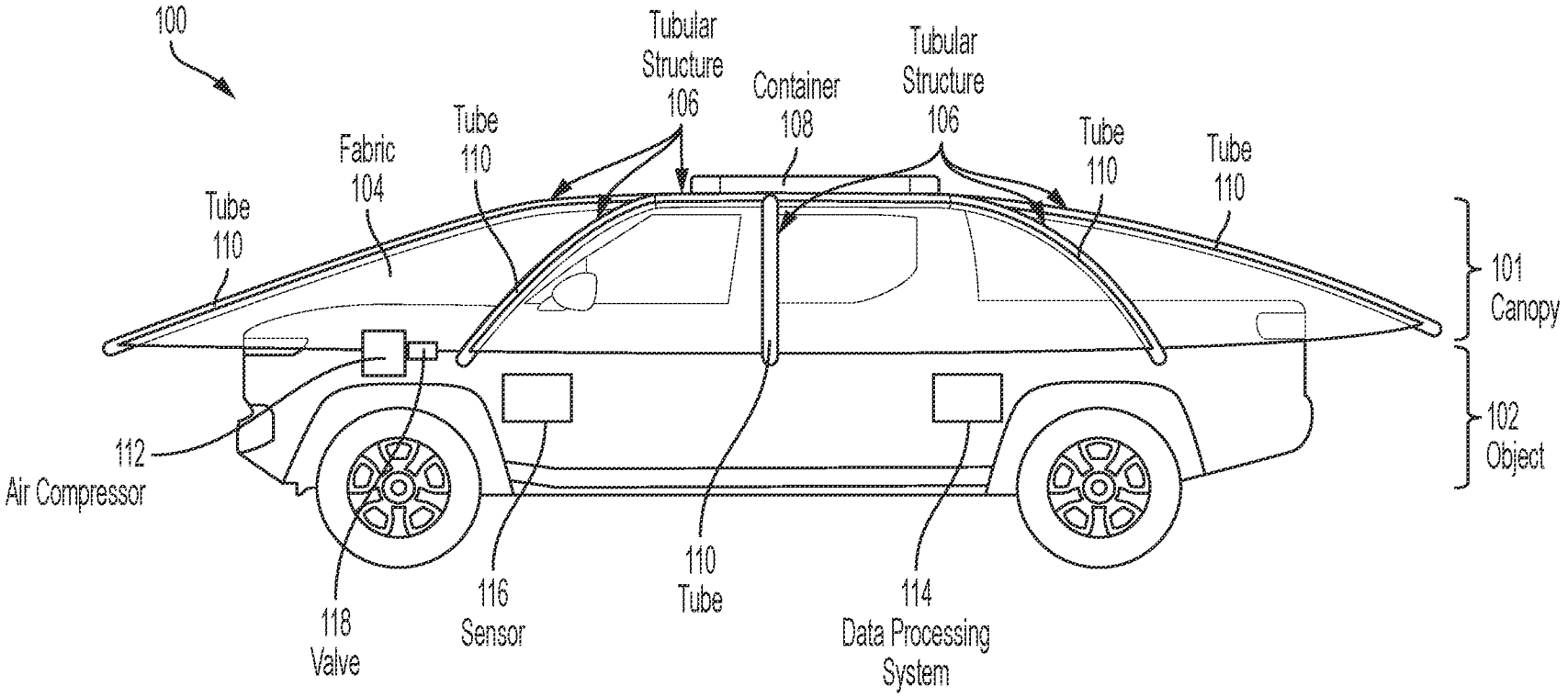
FIG. 1 depicts an example system with a canopy having a deployable structure.

Following below are more detailed descriptions of various concepts related to, and implementations of, methods, apparatus, and systems of a canopy with a deployable structure. The various concepts introduced above and discussed in greater detail below may be implemented in any of numerous ways. In an illustrative example, by providing a canopy with a deployable structure that can be automatically deployed to at least partially cover a vehicle, this technical solution can reduce energy consumption of the vehicle by lowering the temperature of a cabin of the vehicle, thereby reducing the amount of energy used by an air conditioner of the vehicle to cool the cabin. as well as reducing greenhouse gas emissions associated with generation of such energy.

This disclosure is generally directed to a canopy with a deployable structure. For example, the technology can automatically deploy a canopy over an object, such as a vehicle or boat, to protect the object from hail, rain, or sun. The technology can automatically retract the canopy and store the canopy in a container, such as a roof-mounted container that can remain on the roof of a vehicle. The canopy can be constructed with deployable structure such as an inflatable, tubular structure that—when inflated—at least partially covers, encloses or envelopes the vehicle with a durable fabric. The canopy can be tied down to the vehicle, or supported by support structures to provide an awning.

It can be challenging or cumbersome to store and deploy a protective cover for a vehicle or other object. Protective covers may be heavy, which when stored on a vehicle, can reduce the efficiency of the vehicle or cause the vehicle to utilize or consume additional energy or battery resources when driving. Manually extending and storing the protective cover can cause additional wear and tear on the cover, which can reduce the lifespan of the cover or reduce the efficacy of the protection provided by the cover.

Thus, systems, methods and apparatus of this technical solution can provide a canopy with a deployable structure that can be automatically deployed from a container on the roof of a vehicle, and automatically retracted and stored in the container for subsequent use. The deployable structure of the canopy of this technical solution can include tubes that can be inflated by an air compressor that is integrated in the vehicle. When inflated, the deployable structure can extend a fabric over at least a portion of the vehicle. Further, when deflated, the deployable structure can include a steel spring that causes the deployable structure to compress and retract back into the container for storage. Thus, the canopy with the deployable structure of this technical solution can be automatically deployed and retracted for multiple uses. It should be noted that the structures described herein are provided for example and illustrative purposes and should not be interpreted in a limiting manner. For example, the structures described herein may be described as tubular, but may or may not be hollow or tube-like as various other implementations are possible.

In some cases, a data processing system of this technical solution can monitor conditions of the vehicle in order to determine whether to deploy or retract the canopy. For example, the data processing system can determine to automatically deploy the canopy when the interior of the vehicle is not occupied by the driver or any passengers, the doors are locked, and it is raining, hailing or snowing on the vehicle (or the forecasts calls for precipitation). In another example, the data processing system can determine to automatically deploy the canopy when the interior of the cabin of the vehicle exceeds a temperature threshold, such as 100 degrees Fahrenheit. In another example, the data processing system can determine to automatically retract and store a deployed canopy when the data processing system detects that a driver of the vehicle has unlocked the doors to the vehicle or is approaching the vehicle.

Thus, the data processing system of this technical solution can control the automatic canopy and tubular structure of this technical solution to deploy and retract the canopy based on conditions monitored or sensed within the vehicle. By automatically deploying the canopy when the cabin temperature exceeds a predetermined temperature threshold, for example, the data processing system of this technical solution can reduce the temperature of the cabin of the vehicle without having to use an air conditioner or heat pump of the vehicle, thereby conserving or utilizing less battery power or energy and improving the range of the vehicle. For example, the energy used to deploy the canopy to cover the vehicle can be less than the energy used to cool the cabin, in which case it can be energy efficient to automatically deploy the canopy as compared to activating the cooling system of the vehicle.

FIG. 1 depicts an example system 100 with a canopy 101 having a deployable structure 106. The system 100 can include a canopy 101. The canopy 101 can include or be formed of a structure 106 (which can be referred to as, or include, a deployable structure 106 or a tubular structure 106). The canopy 101 can include or be formed of a fabric 104. The structure 106 (e.g., deployable structure 106 or tubular structure 106) can include or be formed of one or more tubes 110. The tubular structure 106, or the tubes 110 thereof, can be coupled, connected, attached, joined, or otherwise in contact with the fabric 104.

The system 100 can include, interface with, interact with, or otherwise utilize an air compressor 112. The air compressor 112 can inflate the tubular structure 106 with air or another gas in order to deploy the canopy 101. When the canopy 101 is deployed, the air compressor 112 can inflate the tubular structure 106 to cause the tubes 110 to extend the fabric 104. For example, the air compressor 112 can deploy the canopy 101 to at least partially cover an object 102, such as vehicle 1002 depicted in FIG. 10 or a boat.

The system 100 can include, interface with, interact with, or otherwise utilize a container 108. The container 108 can store the canopy 101, which can include the tubular structure 106 (e.g., tubes 110) and the fabric 104. The container 108 can be located on the object 102. For example, the container 108 can be located on a roof of a vehicle. The container 108 can be coupled to the object 102. For example, the container 108 can be coupled to the object 102 such that when the object 102 moves, the container 108 can remain attached to the object 102.

The tubular structure 106 (or structure 106 or deployable structure 106) can include one or more tubes 110. The tubular structure 106 can refer to a structure formed of multiple tubes 110. The tubular structure 106 can be designed, constructed, and operational to deploy to extend the fabric 104, and support the fabric 104 over an object 102. The tubular structure 106 can be designed, constructed and operational to provide structural support for the fabric 104 as the fabric 104 is at least partially extended over the object 102, or otherwise extended from the object 102.

The tubular structure 106 can provide support to the fabric 104 in various environments or under various circumstances. For example, the tubular structure 106 can support the fabric 104 under weather conditions such as rain, hail, or snow. The tubular structure 106 can support the fabric 104 under several inches of snow, such as 2 inches of snow, 3 inches of snow, 4 inches of snow, 6 inches of snow, or more. The tubular structure 106 can support the fabric 104 in windy conditions, including wind speeds such as 5 miles per hour, 10 miles per hour, 15 miles per hour, 20 miles per hour, 25 miles per hour, 30 miles per hour, or more.

To do so, the tubular structure 106 can include multiples tubes 110. The tubes 110 can be joined together at a central point, such as under the container 108. In some cases, the tubes 110 can be hollow or at least partially hollow such that the tubes 110 can be inflated with a gas or air. In some cases, the tubes 110 may not be hollow or contain another shape or geometry that facilitates deploying the tubes 110 from a container 108. The tubes 110 can be made of any material. The tubes 110 can be made of, formed from, or include a material that is waterproof or hydrophobic. The material can be self-lubricating. The material can include, for example, poly propylene, plastic, nylon, rubber, or latex. The material can include fabrics that are laminated to provide an airtight tube 110 that can be inflated by the air compressor 112.

The tubes 110 can be joined together at a central point under the container 108. The tubular structure 106 can include one or more valves 118 through which the air compressor 112 can inflate the tubular structure 106. For example, the tubes 110 can converge and join together at a central point that is accessible to the valve 118 coupled to the air compressor 112 via a hose or pipe. In some cases, each tube 110 can include a valve 118 through which the air compressor 112 can inflate the tube 110.

The tubes 110 can be attached to a fabric 104. The fabric 104 can be coupled, affixed, or attached to the tubes 110 using one or more technique or material. For example, the fabric 104 can be glued to the tubes 110 (or tubular structure 106) via an adhesive. The fabric 104 can be stitched to the tubes 110 using thread. The fabric 104 can be coupled with the tubes 110 via a fastener such a Velcro (e.g., a fastening tape including opposing pieces of fabric, one piece with an arrangement of nylon hooks and another piece with loops, which adhere to one another when pressed together), a zipper (e.g., a device including two flexible strips of metal or plastic with interlocking projections closed or opened by pulling a slide along the two flexible strips), or magnets.

The fabric 104 can be made of, formed from, or otherwise include any material. The material of the fabric 104 can be waterproof, water resistant or hydrophobic. The material of the fabric 104 can be breathable. The material of the fabric 104 can be self-lubricating. The material of the fabric 104 can be the same as or different from the material of the tube 110. The material of the fabric 104 can include poly propylene, plastic, nylon, rubber, or latex. The material of the fabric 104 can include polyester, canvas, cotton, polycotton, or stretched polytetrafluoroethylene ("expanded PTFE" or "ePTFE"), for example.

The container 108 can refer to or include any enclosure, housing, receptacle, vessel or holder that can store, stow or otherwise hold or contain at least a portion of the canopy 101. The container 108 can store or hold at least a portion of the tubular structure 106 or fabric 104. The container 108 can protect the canopy 101 when the canopy is not in use and retracted into the container 108. The container 108 can be coupled or attached to the object 102. For example, the container 108 can be attached to the object 102 via screws, nuts, bolts, nails, or an adhesive. The container 108 can be attached to a roof of a vehicle via a suction cup or magnets, for example. The container 108 can be coupled with a roof of the vehicle via a roof rack or other component that is coupled to a roof of the vehicle.

The air compressor 112 can refer to or include a pneumatic device that can convert power (e.g., using an electric motor or gasoline engine) into potential energy stored in pressurized air (e.g., compressed air). The air compressor 112 can supply air into the tubular structure 106 or tubes 110 thereof to inflate the tubes 110. The air compressor 112 can inflate the tubes 110 to a predetermined or desired pressure.

The air compressor 112 can be of any type, such as a reciprocating compressor, which can use a piston to compress the air. The compressor 112 can include a cylinder, a piston, and a crankshaft. The piston can move back and forth inside the cylinder, driven by the crankshaft. As the piston moves down, the piston can draw in air through an intake valve and into the cylinder. When the piston moves up, the piston can compresses the air, raising the temperature and pressure of the air. The compressed air can then pushed out of the cylinder through an exhaust valve and into the tube 110 in order to inflate the tube 110. Other types of air compressors 112 can include, for example, rotary screw compressors, which use two meshed screws to compress the air, and centrifugal compressors, which use a spinning impeller to compress the air.

Figure 6:
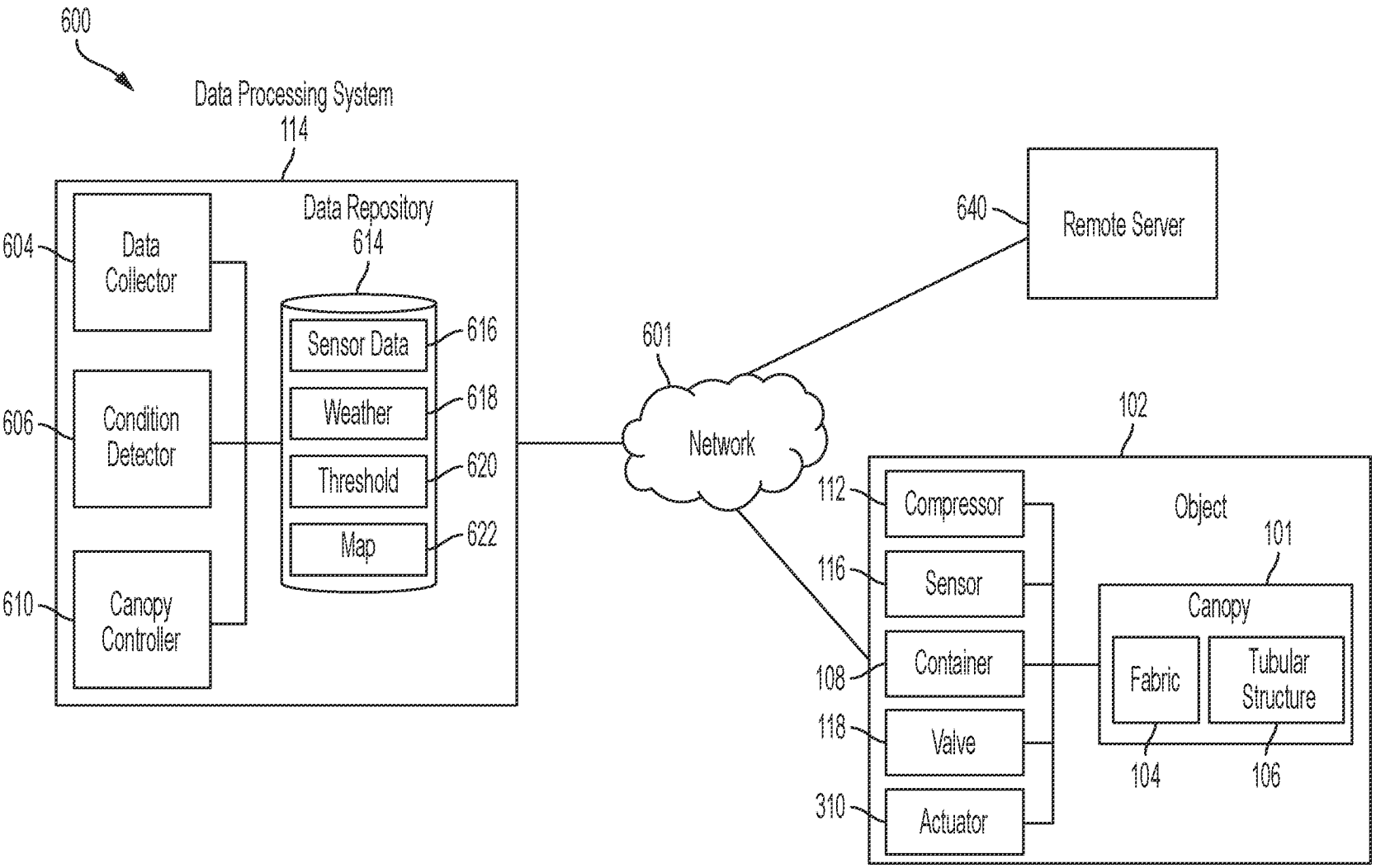
FIG. 6 depicts an example system to deploy a canopy with a deployable structure.

The system 100 can include, interface with, interact with, or otherwise utilize a data processing data processing system 114. The data processing data processing system 114, an example of which is depicted in FIG. 6, can provide one or more functionality associated with deploying and retracting the canopy 101. The system 100 can include, interface with, interact with, or otherwise utilize at least one sensor 116. The data processing data processing system 114 can receive data from the sensor 116 in order to perform or provide one or more functionality associated with the deploying and retracting the canopy 101.

The sensors 116 can detect weather conditions. For example, the sensors 116 can include one or more of: a temperature sensor (e.g., to measure ambient temperature), a humidity sensor (e.g., to measure the amount of moisture in the air or relative humidity), a barometer (e.g., to measure the atmospheric pressure), an anemometer (e.g., to measure the wind speed), a wind vane (e.g., to measure the direction of the wind is blowing), a rain gauge (e.g., to measure the amount of precipitation, such as rain or snow), a cloud cover sensor (e.g., to measure the amount of cloud cover), or a solar radiation sensor (e.g., to measure the amount of solar radiation or sunlight received by the sensor). Thus, sensors 116 can be used individually or in combination to measure various weather parameters, such as temperature, humidity, wind speed and direction, precipitation, cloud cover, or solar radiation.

Sensor 116 can include an occupancy sensor to determine whether a cabin of a vehicle is occupied. Sensor 116 can include a proximity sensor to determine whether there are any obstacles around the object 102 or vehicle that may prevent the canopy 101 from deploying. For example, the sensor 116 can include a transducer that can determine the proximity of obstacles to the vehicle or object 102 or the distance between such obstacles and the object 102. If the data processing data processing system 114 determines the distance between the obstacle (e.g., another object or vehicle, a tree, a building, or a person) is less than a threshold distance or less than a dimension of the canopy 101, then the data processing system can determine to block, prevent, or stop deployment or inflation of the canopy 101. The data processing data processing system 114 can determine to retract the canopy 101 if the data processing data processing system 114 had already begin deploying the canopy 101 when the obstacle is detected.

Figure 2:
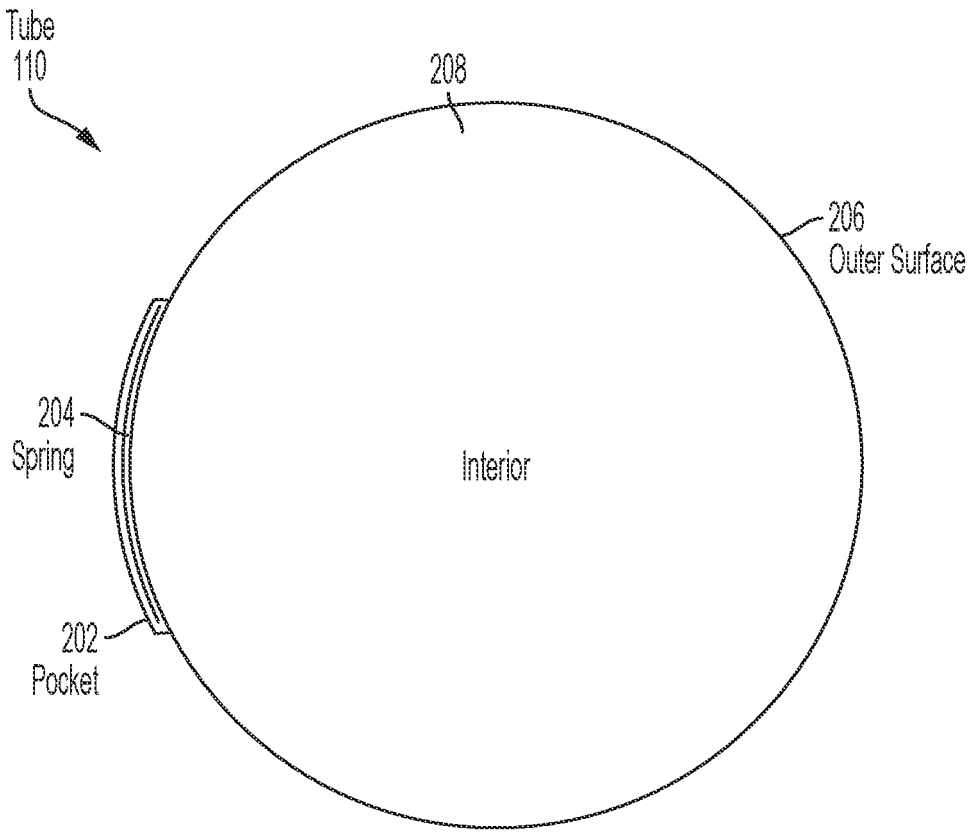
FIG. 2 depicts an example tube that forms a deployable structure.

FIG. 2 depicts an example tube 110 that forms or is part of a deployable structure 106. The tube 110 can include an outer surface 206 that forms the tube 110. The tube 110 can include an interior 208 in which air or gas is pumped into the tube 110 via the air compressor 112 to inflate the tube 110 and deploy the tubular structure 106. The tubular structure 106 can include a pocket 202. The pocket 202 can house, store, cover, or otherwise hold a spring 204. The spring 204 can cause the tube 110 (or tubular structure 106) to retract. For example, during deployment of the canopy 101, the air compressor 112 can inflate the tubes 110 (or tubular structure 106 formed from the tubes 110) with air or another gas to increase the amount of pressure within the tubes 110. The air compressor 112 can increase the amount of pressure beyond a threshold or amount such that the force exerted on or within the tubes 110 exceeds a spring force applied or exerted by the spring 204. When the force exerted by the pressure of the air within the tubes 110 exceeds the force exerted by the spring 204, the tubular structure 106 can expand and extend the fabric 104, thereby deploying the canopy 101 to at least partially cover the object 102.

To retract the canopy 101, the pressure within the tubes 110 can be released or reduced such that the force exerted by the air within the tubes 110 is less than the spring force exerted by the spring 204. When the spring force exerted by the spring 204 is greater than the force exerted by the air pressure within the tube 110, the spring force can cause the tubular structure 106 to retract and deflate. The spring force applied by the spring 204 can further cause the tubular structure 106 to retract into the container 108. For example, the spring 204 can pull the tubular structure 106 into the container 106. The spring 204 can facilitate storing or stowing the canopy 101 in the container 108.

To retract the canopy 101, a data processing data processing system 114 can send a command or instruction to a valve that can open and close. The valve can open to allow air or another gas to flow into or out of the tubular structure 106. The valve can close to prevent air or another gas from flowing into or out of the tubular structure 106. In some cases, the valve can be part of or coupled to the air compressor 112. In some cases, the air compressor 112 can control the state of the valve between open and closed, for example. The data processing data processing system 114 can determine to open the valve to allow the air compressor 112 to pump air into the tubular structure 106 to inflate the tubular structure 106, and open the valve to deflate the tubular structure 106 and retract the tubular structure 106 and canopy 101 into the container 108. Thus, opening the valve can cause the air or other gas in the tubular structure 106 to escape, which can allow the spring 204 to retract the tubular structure 106.

Example valves 118 that can be used to facilitate inflation or deflation of the tubular structure 106 can include pin valves, twist valves, or one-way valves. Pin valves can include a pin to open and close the valve, and a rubber seal that can reduce or prevent air leakage. Twist valves can include a twisting mechanism to open and close the valve. A one-way valves can allow air to flow in one direction only, which can reduce or preventing air leakage.

Example springs 204 can include extension springs, torsion springs, or spiral springs. Extension springs 204 can store energy when the tubular structure 106 is inflated and the canopy is extended, which energy can be released when the spring 204 is allowed to contract. Torsion springs 204 can store energy when twisted, and release energy when allowed to untwist. Spiral springs 204 can be shaped like a spiral and can store energy when compressed or extended.

The spring 204 can be designed, constructed and operational to bend in one direction to direct or guide the deployment of the tubular structure 106. For example, the spring 204 can guide the tubular structure 106 and canopy 101 to extend out from the container and bend towards a ground or bottom portion of the object 102 (e.g., extend towards the wheels of the vehicle 1002). Thus, the springs 204 can control, guide or otherwise facilitate the deployment of the canopy 101 in a predetermined or desired orientation, configuration or shape.

Figure 3:
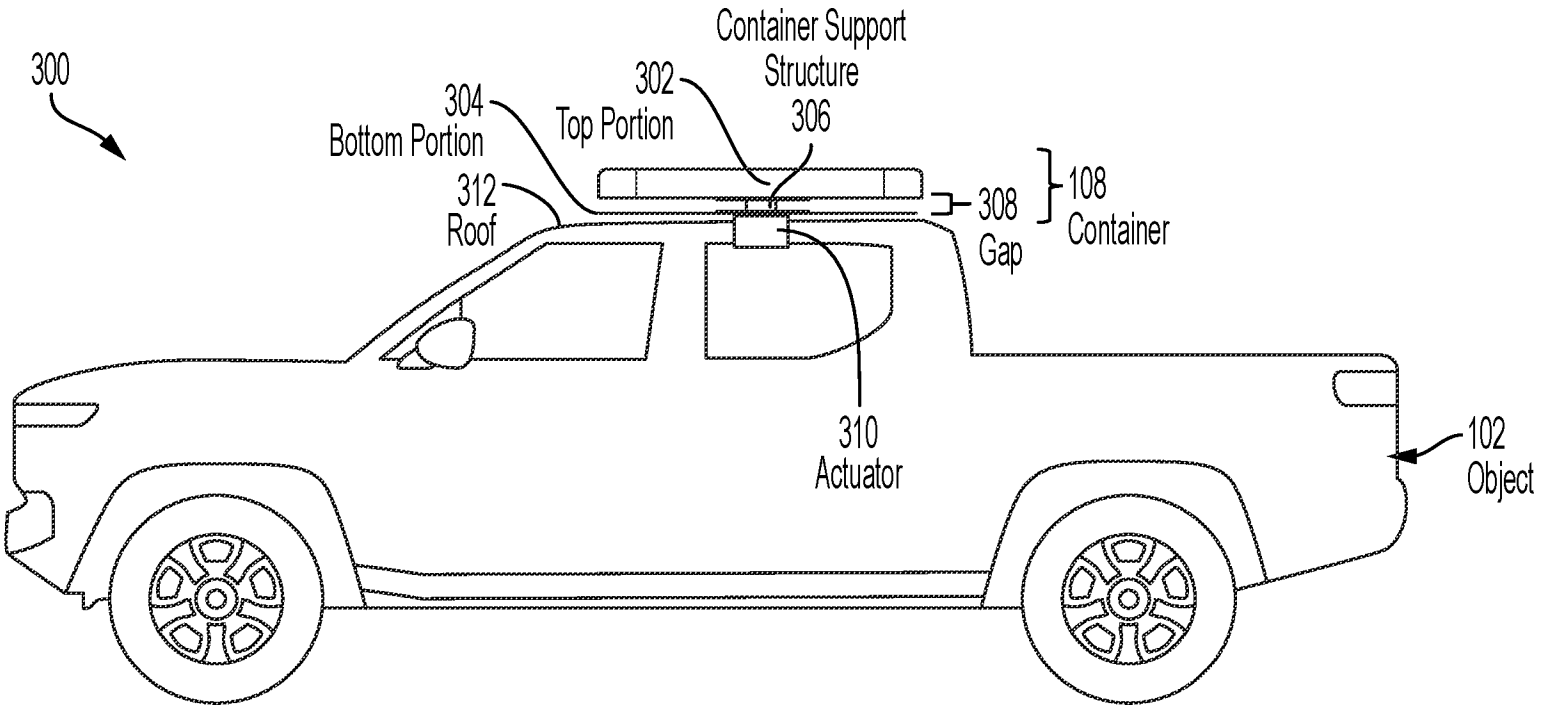
FIG. 3 depicts an example container for the canopy.

FIG. 3 depicts an example container 108 for the canopy 101. The system 300 can include the container 108. The container 108 can include or be formed of one or more components, such as a top portion 302, bottom portion 304, or container support structure 306. The container support structure 306 can facilitate supporting the top portion 302. The container support structure 306 can extend to lift the container support structure 306. For example, the container support structure 306 can separate the top portion 302 from the bottom portion 304 to create or cause a gap 308 or opening or other separation between the top portion 302 of the container 108 and the bottom portion 304 of the container 108. By creating the gap 308, the container support structure 306 can allow the canopy 101 stored within the container 108 to deploy responsive to inflation of the tubular structure 106, as illustrated in FIG. 1, for example.

The components of the container 108 can be formed of the same or different materials of the container 108, including, for example, plastic, metal, glass, rubber, or alloys. The container support structure 306 can be controlled by an actuator 310 that can extend and retract the container support structure 306 to open and close the container 108 by opening the gap 308 and closing the gap 308. The data processing data processing system 114 can determine to actuate the actuator 310 of the container support structure 306 responsive to a determination to deploy the canopy 101 or retract the canopy 101. Example actuators 310 can include lever actuators (e.g., a lever that can apply force to open and close the container 108), pneumatic actuators (e.g., apply air pressure to apply force to open the container), hydraulic actuators (e.g., use fluid pressure to apply force to open the container 108), electrical actuators (e.g., use electricity to power a motor or other device to apply force to open the container 108), or mechanical actuators.

In some cases, the actuator 310 can refer to or include a spring. For example, pressure applied by the air compressor 112 to inflate the tubular structure 106 can cause the container 108 to open responsive to the inflation of the tubular structure 106. The container support structure 306 can include a spring actuator 310 that applies a spring force. The container 108 can open responsive to the force exerted by the inflating tubular structure 106 exceeding the spring force applied by the spring actuator 310 of the container support structure 306. Responsive to deflating the tubular structure 106, the spring force of the spring actuator 310 can exceed the force applied by the pressure of the tubular structure 106, which can cause the container support structure 306 to retract and close the container 108.

The container 108 can include a locking mechanism, such as a latch, that can engage when the container 108 is closed to prevent the container 108 from opening inadvertently or when not in use. The data processing data processing system 114 can transmit a command or instruction to unlock the locking mechanism to open the container 108 responsive to a determination to deploy the canopy 101.

The container 108, or bottom portion 304 thereof, can be coupled to the roof 312 of the object 102 (e.g., vehicle 1002). The bottom portion 304 can be coupled, connected, affixed, secured to, or otherwise fastened to the roof 312 of the object. For example, the container 108 can be screwed to the roof 312, bolted to the roof 302, glued to the roof 312, or welded to the roof 312. In some cases, the container 108 can be coupled to the roof 312 via a suction cup or magnets.

Figure 4:
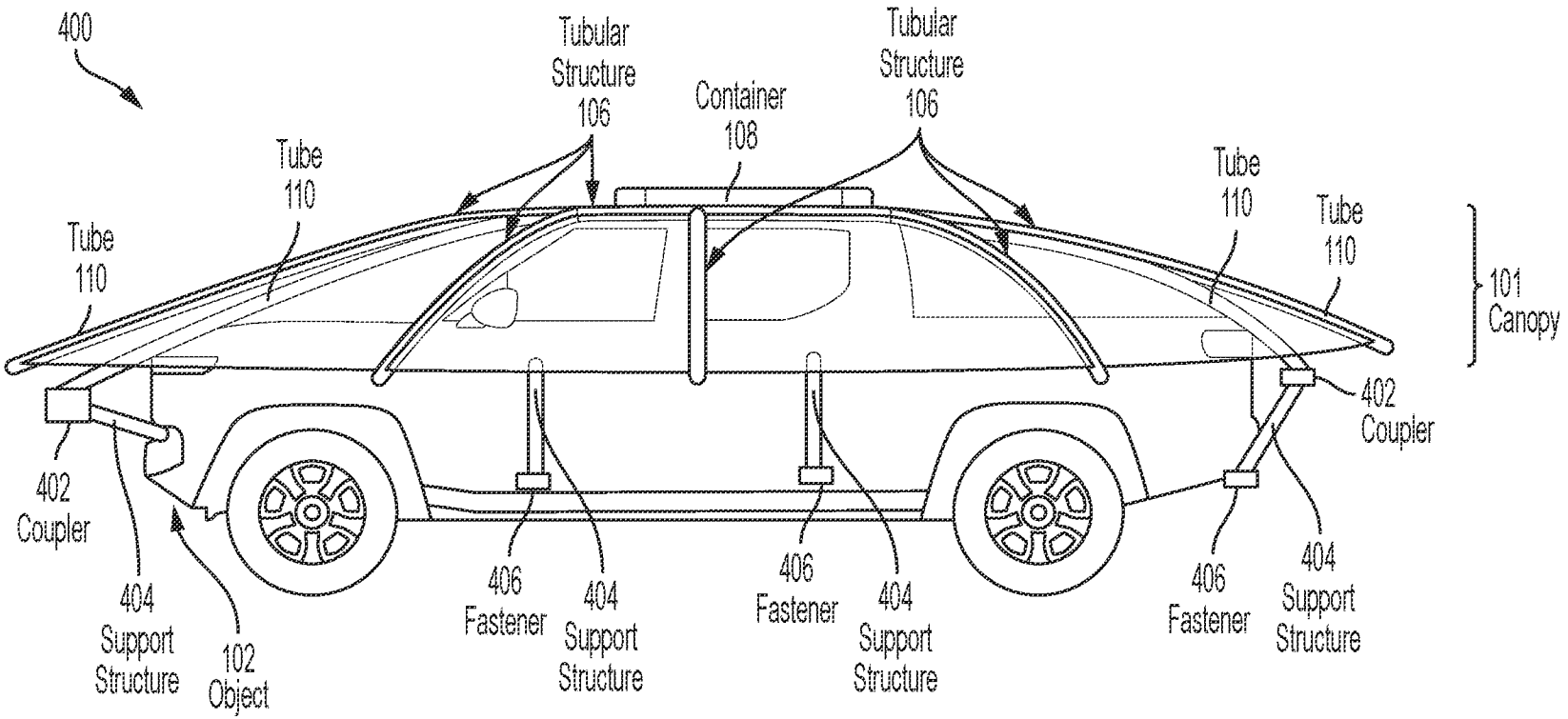
FIG. 4 depicts an example canopy with a deployable structure.

FIG. 4 depicts an example system 400 that includes a canopy 101 with a deployable structure 106. The system 400 can include one or more component or functionality depicted in FIGS. 1-3. As illustrated in FIG. 4, the system 400 can include support structures 404 to support the canopy 101. The system 400 can include a coupler 402 to connect or otherwise couple the support structure 404 to a tube 110. The system 400 can include a fastener 406 to couple or otherwise connect the support structure 404 to the object 102.

The support structures 404 can be coupled to a tube 110 of the tubular structure 106 via a coupler 402. The support structures 404 can include any type of material or component designed, constructed and operational to provide support or prop up the canopy 101, or to otherwise hold the canopy 101. The support structure 404 can include, for example, a belt, cable or rope that pulls down the canopy 101.

The coupler 402 can include any type of component or mechanism that connects the support structure 404 to the tube 110. The coupler 402 can include a hooking mechanism, latching mechanism, magnet, adhesive, Velcro, zipper, or buckle.

The fastener 406 can include a tie down loop that hooks onto a portion of the object 102. For example, the fastener 406 can include a tie down loop that attaches or connects to a bottom portion of the vehicle. The fastener 406 can include a hooking mechanism, latching mechanism, magnet, adhesive, Velcro, zipper, or buckle.

The system 400 can include multiple support structures 404. Each support structure 404 can be associated with a corresponding coupler 402 and fastener 406, for example. In some cases, each tube 110 can have a corresponding support structure 404. In some cases, a subset of the tubes 110 of the tubular structure 106 can be supported by support structures 404.

The support structures 404, when coupled to the object 102 via fastener 406, can facilitate holding the canopy 101 in a desired position, place, or shape. For example, by coupling the ends of the tubes 110 to the bottom of the object 102 via fastener 406 and support structure 404, the system 400 can pull down the canopy 101 and prevent wind from pushing up or inverting the canopy 101.

Figure 5:
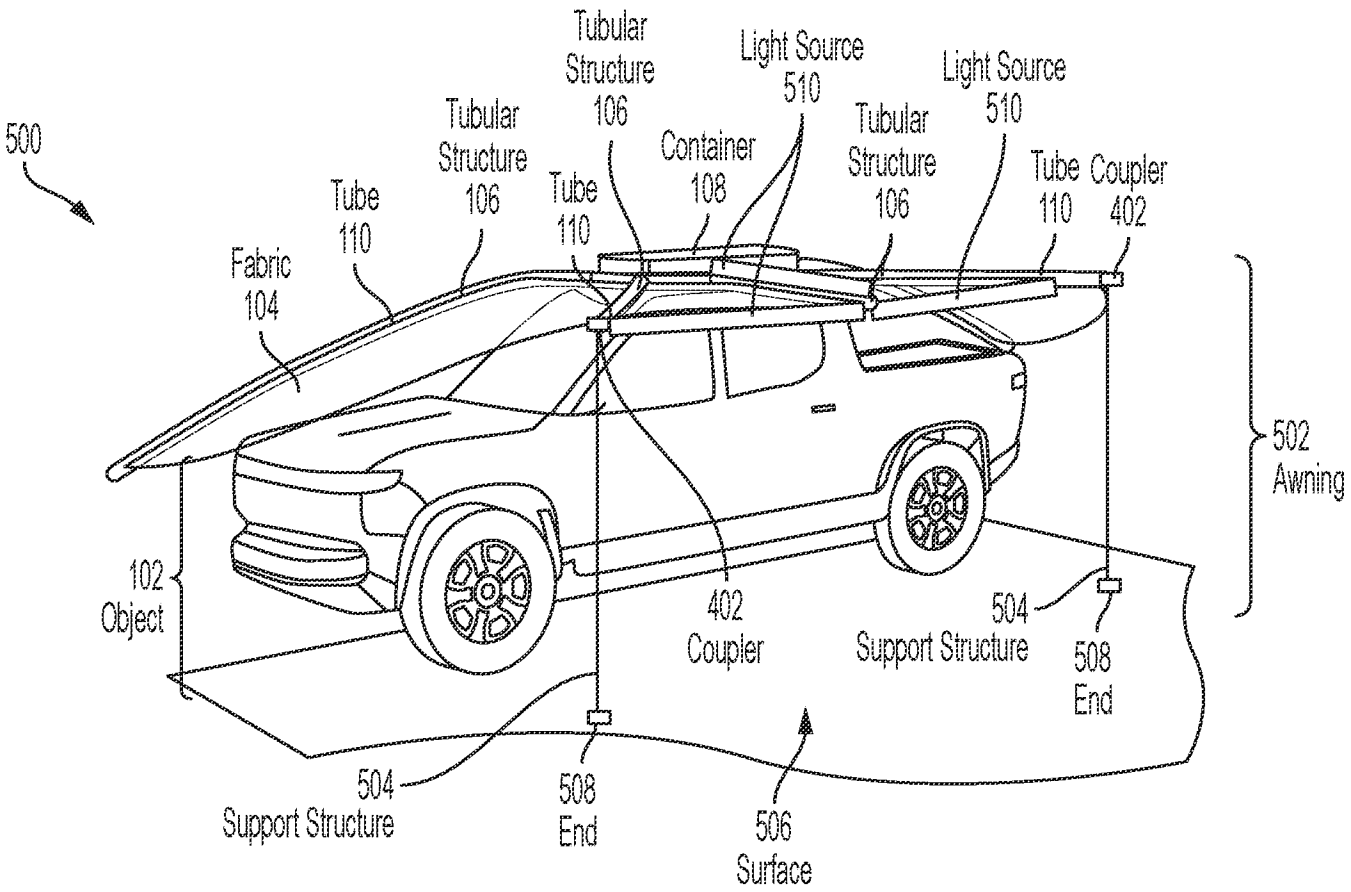
FIG. 5 depicts an example of an awning with a deployable structure.

FIG. 5 depicts an example of an awning with a deployable structure 106. The system 500 can include a tubular structure 106 formed from multiples tubes 110. The tubes 110 can be coupled with fabric 104 and can extend the fabric 104 when the tubes 110 are inflated. The system 500 can include awning 502. The system 500 can include one or more support structures 504 that can support the awning 502, or at least a portion of the awning 502.

The canopy 101 can form an awning 502. The awning 502 can be part of the canopy 101, in some cases. The awning 502 can be deployed over at least one side of the object 102. The awning 502 can be supported by one or more support structures 504 that couple to one or more tubes 110 of the tubular structure 106 of the canopy 101. The awning can include or be made from the same material as the canopy 101, fabric 104 or tubes 110. The awning 502 or canopy 101 can provide shade or protect against rain and other weather conditions.

The awning 502 can connect to support structures via one or more couplers 402. The support structures 504 can contact a surface 506, such as the surface of the earth or ground. For example, the object 102 can include a vehicle that is located or parked on a surface 506 such as a camping site, sand on a beach, dirt road, pavement, parking lot, or grass. The support structure 504 can have an end 508 that comes into contact with the surface 506. The end 508 of the support structure 504 that contacts the surface 506 can include a spike or a contact pad. For example, a spike end 508 of the support structure 504 can be designed, constructed and operational to pierce the surface 506 and enter the surface 506 in order to couple the support structure 504 with the surface 506. In another example, the end 508 of the of the support structure 504 can include a rubber contact pad or plastic contact pad that can contact a paved surface 506 to provide traction for the support structure 504 to prevent the support structure 504 from slipping.

The awning 502 can include a light source 510. The light source 510 can be affixed to, coupled with, attached to, or integrated with the fabric 104, tubular structure 106, tube 110, or other portion of the awning 502. The light source 510 can be stitched to the fabric 104 or tubular structure 106, glued to the fabric 104 or tubular structure 106, or otherwise fastened or secured to the fabric 104 or tubular structure 106. For example, the light source 510 can be integrated with the fabric 104 or tubular structure 106 such that when the awning 502 is deployed, the awning 502 is equipped with lighting and can provide light onto at least a portion of the surface 506. The light source 502 can be attached to a side of the awning 502, bottom portion of the awning 502 (e.g., a portion that faces the surface 506), or a top portion of the awning 502.

The light source 510 can include any type of light source, including, for example, light emitting diodes. The light source 510 can include or be contained in a light fixture. The light source 510 can include a strip of flexible lighting. For example, the light source 510 can include a flexible light strip that can be attached to the fabric 104 and is capable of being stored in the container 108 when the awning 502 is retracted. Thus, when the awning 502 is deployed from the container 108, the light source 510 can be deployed together with, along with, or as part of the fabric 104. The light source 510 can receive electric power. The light source 510 can be electrically connected or coupled to a battery, for example a battery of vehicle 1002.

FIG. 6 depicts an example system 600 to deploy a canopy with a deployable structure. The system 600 can include a data processing data processing system 114. The data processing data processing system 114 can interface or communicate with a remote server 640. The data processing data processing system 114 can interface with or communicate with one or more components of an object 102. The data processing data processing system 114 can be integrated with the object 102, coupled with the object 102, located on the object 102, or otherwise interact with the object 102 or facilitate deploying a canopy 101 for or at least partially over the object 102. In some cases, the data processing system 114 can interface or component with one or more component of the object 102 via network 601.

The data processing data processing system 114 can include a data collector 604 that can obtain data via network 601 or one or more sensors 116. The data processing data processing system 114 can include a condition detector 606 to identify or detect one or more conditions or events associated with the object 102 or environment surrounding the object 102. The data processing data processing system 114 can include a canopy controller 610 to facilitate or cause the deployment or retraction of the canopy 101, such as via inflating the tubular structure 106. The data processing data processing system 114 can include a data repository 614 that stores, manages, or otherwise maintains information that facilitates deploying or retracting the canopy 101. The data collector 604, the condition detector 606, the canopy controller 610, and the data repository 614 can communicate with one another.

The data collector 604, condition detector 606, or canopy controller 610 can each include at least one processing unit or other logic device such as programmable logic array engine, or module configured to communicate with the data repository 614 or database. The data collector 604, condition detector 606, or canopy controller 610 can be separate components, a single component, or part of the data processing data processing system 114. The system 600 and its components, such as a data processing data processing system 114, can include hardware elements, such as one or more processors, logic devices, or circuits.

The data processing data processing system 114 can interface with, communicate with, or otherwise receive or provide information with one or more of the remote server 640, compressor 112, sensor 116 or canopy 101 via a network 601. The remote server 640, object 102, compressor 112, sensor 116 or canopy 101 can each include at least one logic device such as a computing device having a processor to communicate via the network 601. The data processing data processing system 114 or remote server 640 can include at least one computation resource, server, processor or memory. For example, the data processing data processing system 114 can include a plurality of computation resources or processors.

The network 601 can include computer networks such as the Internet, local, wide, metro, or other area networks, intranets, satellite networks, and other communication networks such as voice or data mobile telephone networks. The network 601 can include wired or wireless networks, connections, or communication channels. The network 601 can be used to transmit or receive information or commands to or from various components or sources. For example, the sensor 116 or compressor 112 can be hardwired or connected to the data processing data processing system 114 via a physical wire or cable via a communication port. The network 601 may be any type or form of network and may include any of the following: a point-to-point network, a broadcast network, a wide area network, a local area network, a telecommunications network, a data communication network, a computer network, an ATM (Asynchronous Transfer Mode) network, a SONET (Synchronous Optical Network) network, a SDH (Synchronous Digital Hierarchy) network, a wireless network and a wireline network.

The data repository 614 can store one or more of sensor data 616, weather data 618, thresholds 620, or maps 622. Sensor data 616 can include data from one or more sensors 116. For example, sensor data 616 can include temperature information. The temperature information can correspond to a temperature internal or within the object 102, or external or outside the object 102. For example, the temperature information can include a temperature of a cabin. The temperature information can include the temperature of a component of the vehicle, such as the compressor 112, fabric 104, tubular structure 106, or container 108, for example. The temperature information can include an ambient temperature of an environment outside the vehicle, such as the outside temperature or environmental temperature. Sensor data 616 can include information collected, identified or measured by sensors 116, such as humidity, pressure, wind speed, wind direction, precipitation, cloud cover, or solar radiation. Sensor data 616 can include information about movement of the object 102, location of the object 102, altitude of the object 102.

Sensor data 616 can include information about occupancy of the vehicle, which can be detected by a proximity sensor in the cabin of the vehicle or a pressure sensor on a seat of the vehicle. Sensor data 616 can include information detected by a motion sensor located within or external to the vehicle. Sensors Weather data 618 can include data about weather in the area of the object 102. The data processing data processing system 114 can obtain the weather data 618 from a remote server 640 via network 601. For example, the remote server 640 can include a weather data repository or resource. Weather data 618 can include a weather forecast for a geographic location at which the object 102 is located. The weather forecast can include, for example, temperature, precipitation, wind speed, cloud cover, or solar radiation information for the location for the next hour, 2 hours, 3 hours, 4 hours, 5 hours, 6 hours, or other time interval that can facilitate automatic deployment of a canopy.

Threshold data 620 can include data about conditions relating to the canopy deploying. Threshold data 620 can include data about conditions relating to the canopy retracting. Threshold data 620 relating to the canopy retracting can prevent the canopy from deploying. Threshold data 620 can be a threshold that initially prevents the canopy from deploying. Threshold data 620 can include a threshold temperature for the canopy deploying when the threshold is reached. The temperature can be a temperature within a cabin of the vehicle or object, or an external or environmental temperature. For example, the data processing data processing system 114 can determine to deploy the canopy if the temperature of a cabin of the vehicle is greater than or equal to a first temperature threshold, such as 80° F., 85° F., 90° F., or 95° F. The data processing data processing system 114 can determine to retract the canopy if the temperature of the cabin or external temperature is less than or equal to a second temperature threshold, such as 60° F., 50° F., 40° F., 30° F., or 20° F. The temperature threshold can have units of degrees Fahrenheit, Celsius, or Kelvin.

Threshold data 620 can include a wind speed threshold that prevents the canopy from deploying if the wind speed is exceeded. For example, a first wind speed threshold can be fifteen miles per hour. A wind speed above fifteen miles per hour can prevent the canopy from deploying. A wind speed below fifteen miles per hour can allow the data processing data processing system 114 to deploy the canopy. A wind speed above the wind speed threshold can cause the canopy to retract, thereby preventing damage to the canopy 101 or materials thereof. A wind speed above the wind speed threshold can cause the canopy to retract into a container configured to store the canopy. The wind speed threshold can have units of miles per hour or kilometers per hour.

Threshold data 620 can include a vehicle speed threshold that prevents the data processing data processing system 114 from deploying the canopy 101 when the vehicle or object is moving or moving at a speed greater than a threshold speed. For example, the vehicle speed threshold can be 2 miles per hour. The data processing data processing system 114 can determine not to deploy the canopy 101 (or otherwise prevent deployment of the canopy) if the vehicle or object is moving at a speed at or above the speed threshold. In the event the canopy 101 is deployed and the data processing data processing system 114 detects that the canopy 101 is currently deployed, the data processing data processing system 114 can determine to retract the canopy if the object 102 or vehicle is moving at a speed greater than or equal to the speed threshold. The vehicle speed threshold can have units of miles per hour or kilometers per hour.

Threshold data 620 can be a first precipitation threshold that when exceeded, causes the canopy to deploy. For example, the precipitation threshold can be the presence of rain. The presence of rain can cause the canopy to deploy. Threshold data 620 can be a second precipitation threshold that when exceeded, causes the canopy to detract. For example, the second precipitation threshold can be 7.6 mm of rain per hour. Precipitation that exceeds 7.6 mm per hour can cause the canopy to retract. Precipitation that causes the canopy to retract can cause the canopy to retract into a container configured to store the canopy. The precipitation threshold can have units of mm per hour. The precipitation threshold can have units of cm per hour. The precipitation threshold can have units of inches per hour. The second precipitation threshold can be the presence of snow. The presence of snow can cause the canopy to retract.

Threshold data 620 can be deployment thresholds. Deployment thresholds can be at least one threshold that, when met, can cause the canopy 101 to be deployed. Deployment thresholds can be at least one threshold that, when not met, can prevent the canopy from being deployed. A deployment threshold can be based on temperature. A deployment threshold can be based on wind speed. A deployment threshold can be based on vehicle speed. A deployment threshold can be based on a volume of precipitation. A deployment threshold can be based on a rate of precipitation. A deployment threshold can be based on a geographic location of the object 102. A deployment threshold can be input from a driver of the electric vehicle.

Threshold data 620 can be retraction thresholds. Retraction thresholds can be at least one threshold that, when met, can cause the data processing data processing system 114 to retract a deployed canopy 101. A retraction threshold can be based on temperature. A retraction threshold can be based on wind speed. A retraction threshold can be based on vehicle speed. A retraction threshold can be based on a volume of precipitation. A retraction threshold can be based on a rate of precipitation. A retraction threshold can be based on a pressure inside of the tubular structure 106. A retraction threshold can be based on a geographic location of the object 102. A retraction threshold can be input from a driver of the electric vehicle.

Map data 622 can be geographical information about the area surrounding the object 102. Map data 622 can be geographical coordinates. Map data 622 can be topographical information about the area surrounding the object 102. Map data 622 can be stored in a lookup table.

The data processing system 114 can include a data collector 604 designed, constructed, or operational to receive, obtain, retrieve, identify, or otherwise access data to facilitate operation of the system 600. The data collector 604 can receive data from one or more data sources. The data collector 604 can receive data or information from one or more sensors 116 or a remote server 640. The sensors 116 can be located on, within, or otherwise associated with the object 102. The object 102 can be a vehicle, such as vehicle 1002 depicted in FIG. 10. The data collector 604 can receive data via a network 601 from a remote server 640. The data collector 604 can store the received data or information in the data repository 614 as sensor data 616, for example. The data collector 604 can send data to and receive data from the data repository 614. The data collector 604 can send data to and receive data from the condition detector 606. The data collector 604 can send data to and receive data from the canopy controller 610.

To receive, collect, retrieve, or otherwise obtain the data, the data collector 604 can establish a communication session or channel with the sensors 116, compressor 112, object 102, or remote server 640. The data collector 604 can include or be configured to utilize a communication protocol, such as a network communication protocol. The data collector 604 can utilize authentication information or credential information to establish the communication session or channel. The data collector 604 can perform a handshaking process with one or more component to establish the communication session or channel.

The data collector 604 can obtain data in a batch mode, real-time, via a data stream or data feed, or responsive to a query, poll, request or ping. The data collector 604 can receive the data with a corresponding timestamp. In some cases, the data collector 604 can apply a timestamp to the received data samples.

The data processing system 114 can include a condition detector 606 designed, constructed and operational to detect one or more conditions or events that facilitate determining whether to deploy or retract the canopy 101. To do so, the condition detector 606 can obtain information from the data repository 614, communicate with the data collector 604, interface with one or more component of the object 102, or communicate with the remote server 640.

To determine whether to deploy the canopy 101, the condition detector 606 can determine or identify whether any conditions or events are present that trigger deployment of the canopy 101. Examples of conditions or events that can trigger the condition detector 606 to deploy the canopy 101 can include: 1) an instruction or command from a user of the object or vehicle to deploy the canopy; 2) temperature being greater than or equal to a temperature threshold; 3) solar radiation being greater than or equal to a solar radiation threshold; 4) precipitation (e.g., rain, freezing rain, hail, or snow); or 5) likelihood of precipitation being greater than or equal to a threshold.

Examples of conditions or events that can prevent or block the condition detector 606 from deploying the canopy 101, or cause the condition detector 606 to retract the deployed canopy 101, can include: 1) an instruction or command from a user of the object or vehicle to retract the canopy; 2) temperature being less than or equal to a temperature threshold; 3) solar radiation being less than or equal to a solar radiation threshold; 4) lack of precipitation (e.g., rain, freezing rain, hail, or snow); 5) likelihood of precipitation being less than or equal to a threshold; 6) wind speed being greater than or equal to a wind speed threshold; 7) proximity of an obstacle to the canopy 101 or object 102; or 8) occupancy of the object 102.

For example, the condition detector 606 the data processing system 114 can receive, via the network 601, a first indication to deploy the canopy 101. The first indication can correspond to an instruction or command from a user of the object or vehicle or the remote server 640 to deploy the canopy, temperature or weather information provided via the remote server 640, or sensor data received from one or more sensors 116 via network 601. After the data processing system 114 deploys the canopy 101 (e.g., via canopy controller 610), the data processing system 114 can receive, via the network 601, a second indication to retract the canopy 101. The second indication can include, for example, an indication that the temperature is forecasted to fall below freezing, the rain has stopped, or the wind speed exceeds a wind speed threshold. The second indication can include a command or instruction from a user of the object to retract the canopy.

The condition detector 606 can receive data from a sensor 116 of the vehicle. For example, the data received from the sensor 116 can be a temperature outside of the vehicle. The condition detector 606 can detect, based on the data from the sensor, a condition. The condition can be a threshold that correlates to the data received from the sensor 116. The condition can be a physical condition that deploying the canopy 101 can alleviate. For example, the condition can be a high temperature in the electric vehicle. Deploying the canopy 101 can alleviate the high temperature by providing shade. The condition can be rainfall. The canopy 101 can alleviate the rainfall by providing a shelter from the rain. The condition detector 606 can determine, responsive to the condition detected based on the data, to deploy the canopy 101. The condition detector 606 can communicate an instruction to the canopy controller 610 to deploy the canopy 101.

In an illustrative example, to deploy the canopy 101 based on temperature, the condition detector 606 can monitor the temperature of the cabin of the vehicle (e.g., object 102). The condition detector 606 can receive the temperature information collected by sensor 116 via data collector 604 on a periodic basis, based on a time interval, or responsive to a query. The condition detector 606, upon receiving the temperature information (e.g., a current temperature or an average temperature over a time window such as 1 minute, 2 minutes, 3 minutes or 5 minute), can compare the temperature information with a temperature threshold stored in threshold data structure 620 in the data repository 614. If the temperature is greater than or equal to a temperature threshold, such as 80 degrees F., the condition detector 606 can determine that a condition to deploy the canopy 101 is present. Responsive to determining that a condition to deploy the canopy 101 is present, the condition detector 606 can provide an indication to the canopy controller 610 to cause the canopy controller 610 to deploy the canopy 101.

The condition detector 606 can determine to deploy the canopy 101 based on location information or a current location of the object 102 (e.g., a vehicle). The data processing system 114 can be configured to automatically deploy the canopy 101 when the vehicle is parked at a predetermined location. For example, a user of the vehicle can set the data processing system 114 to deploy the canopy 101 when the vehicle is parked in the driveway or parking spot of a home or office of the user of the object 102 or vehicle. Thus, the data processing system 114 can, responsive to the vehicle being parked, determine whether the location of the vehicle. The data processing system 114 can compare the location of the parked vehicle with a stored location. For example, the predetermined location can include a geographic region, area or geofence. The predetermined location can correspond to a street address, or coordinates (e.g., latitude and longitude coordinates).

If the data processing system 114 determines that the location at which the vehicle is parked matches or corresponds to the predetermined location at which to deploy the canopy 101, the data processing system 114 can then determine whether there any conditions present that can block, prevent or override deployment of the canopy (e.g., obstacles, occupancy of the vehicle, low temperature, or wind speed). If the condition detector 606 determines that there are no overriding conditions present, then the condition detector 606 can provide an indication to the canopy controller 610 to deploy the canopy 101 responsive to the location of the vehicle matching or corresponding to the predetermined location.

The data processing system 114 can include a canopy controller 610 designed, constructed and operational to facilitate deployment of the canopy 101 or retraction and storage of the canopy 101 in the container 108. The canopy controller 610 can receive an indication from the condition detector 606 to deploy or retract the canopy 101. The canopy controller 610 can perform one or more checks to determine whether or not to deploy or retract the canopy. For example, the canopy controller 610 can determine whether there are any obstacles or occupants present before deploying the canopy 101.

The canopy 101 can be stored in the container 108. The canopy controller 610 can deploy the canopy 101 from a stored stated or position. To do so, the canopy controller 610 can unlock or open the canopy 101. The canopy controller 610 can activate an actuator 310 that can open or unlock the container 108 in which the canopy 101 is stored. The canopy controller 610 can open a valve 118 that is between the tubular structure 106 and the compressor 112. By opening the valve 118, the canopy controller 610 can allow air or other gas to be pumped into the tubular structure 106 to inflate the tubular structure 106. The canopy controller 610 can transmit or send an instruction or command to activate the compressor 112 to cause the compressor to pump, provide, or deliver air to inflate the tubular structure 106 to deploy the canopy 101.

In some cases, the canopy controller 610 can instruct the compressor 112 to inflate the canopy 101 without first opening the canopy 101. For example, the pressure from inflating the tubular structure 106 can automatically open the canopy 101 or lift a top portion of the canopy 101 to allow the canopy 101 to deploy. In some cases, the canopy controller 610 can unlock the container 108 before activating the air compressor 112.

For example, the canopy controller 610 can cause, responsive to the first indication to deploy the canopy, an air compressor 112 of the vehicle to inflate the tubular structure 106 to a predetermined pressure. The condition detector 606 can send an instruction to the canopy controller 610 to cause the air compressor 112 to inflate the tubular structure 106. The predetermined pressure can be based at least in part on a diameter of the tubular structure 106. The predetermined pressure can be based at least in part on a spring constant of a steel spring 204 that can be housed in a pocket 202 of the tubular structure 106. The predetermined pressure can be greater than be greater than the spring constant of the steel spring 204, causing the steel spring 204 and tubular structure 106 to extend.

The canopy controller 610 can determine to deploy the canopy responsive to a condition or event detected by the condition detector 606. The canopy controller 610 can provide, responsive to the determination to deploy the canopy 101, a command to an air compressor 112 of the vehicle to cause the air compressor 112 to inflate the tubular structure 106. The determination to deploy the canopy 101 can be made by the condition detector 606. Responsive to the determination to deploy the canopy 101, the canopy controller 610 can provide a command to an air compressor 112 of the vehicle to cause the air compressor 112 to inflate the tubular structure 106 to a predetermined pressure. The predetermined pressure can be determined, at least in part, on a spring constant of a steel spring 204 of the tubular structure 106.

The canopy controller 610 can retract the canopy 101. The canopy controller 610 can retract a deployed canopy 101. For example, after the canopy controller 610 deploys the canopy 101, the canopy controller 610 can receive an indication to retract the canopy 101. The canopy controller 610 can receive the indication to retract the canopy 101 from the condition detector 606, or can determine to retract the canopy responsive to a condition or event detected by the condition detector 606.

To retract the canopy 101, the canopy controller 610 can instruct the compressor 112 to stop inflating the tubular structure 106. The canopy controller 610 can deactivate the compressor 112. In some cases, the canopy controller 610 can instruct the compressor 112 to deflate the tubular structure 106 by generating a vacuum to withdraw air or other gas from the tubular structure 106.

The canopy controller 610 can open a valve 118 to release air from the tubular structure 106. For example, the canopy controller 610 can instruct an actuator 310 configured to open or close the valve 118 so as to open the valve 118 and release air from the tubular structure 106. Responsive to deflating the tubular structure 106, the springs of the tube 110 of the tubular structure 106 can exert a force to contract, compress or otherwise retract the tubular structure 106. The springs can pull the tubular structure 106 into the container 108.

The canopy controller 610 can close the container 108 after the canopy 101 has been retracted into the container 108. The canopy controller 610 can lock the container 108 after the canopy 101 has been retracted and stored in the container 108. The canopy controller 610 can instruct an actuator 310 to close the container 108 or activate a locking mechanism of the container 108. In some cases, the canopy controller 610 can monitor the status of deflating the canopy 101, and determine to close the container 108 after a pressure of the tubular structure 106 drops below a pressure threshold that indicates that the tubular structure has been sufficiently deflated.

In an illustrative example, the canopy controller 610 can cause, responsive to a second indication to retract the canopy 101, the tubular structure 106 to deflate and retract into a container 108 for storage. The condition detector 606 can send an instruction to the canopy controller 610 to deflate the canopy 101 below a predetermined pressure. The predetermined pressure can be less than the spring constant of the steel spring 204, allowing the steel spring 204 to retract to its normal state. This can cause the canopy 101 to retract. The tubular structure 106 can deflate and retract into a container 108 for storage.

The data processing system 114 can determine to override one or more settings based on a ranking or priority of conditions. For example, the data processing system 114 can receive a first indication to deploy the canopy, determine based on a first condition associated with the object 102 to prevent or block deployment of the canopy, but then determine based on a second condition to override blocking of the deployment in order to continue with deployment of the canopy 101. For example, the data processing system 114 can receive the first indication from a user of the vehicle to deploy the canopy. The data processing system 114 can detect the first condition as an obstacle proximate to the vehicle, and then determine to prevent or block deployment. The data processing system 114 can provide an audio or visual notification or alert that indicates an obstacle was detected and canopy deployment was blocked or prevented, The data processing system 114 can then detect the second condition corresponding to the obstacle being removed (e.g., a user may have removed the obstacle from the proximity of the vehicle). Responsive to detecting the second condition (e.g., an absence of the obstacle), the data processing system 114 can override the blocked deployment in order to continue with deployment.

In another example, the first indication can be the vehicle parking at a predetermined location for which canopy deployment is configured. The data processing system 114 can detect the first condition as a wind speed being greater than a threshold that is configured to prevent deployment of the canopy. The data processing system 114 can detect the second condition as the wind speed falling below the threshold, thereby allowing the deployment of the canopy.

In another example, the first indication can be an instruction from a user to deploy the canopy. The first condition can be that the wind speed is greater than or equal to the threshold that block deployment. The second condition can be the temperature of the cabin exceeds a temperature threshold. The temperature exceeding the temperature threshold can override the wind speed exceeding the wind speed threshold. In some cases, the data processing system 114 can provide an indication that the second condition is overriding the first condition. The data processing system 114 can provide an indication to fasten support structures (e.g., support structure 404 depicted in FIG. 4) due to the first condition. Thus, the data processing system 114 can determine to override determinations to deploy, block deployment, or retract the canopy based on one or more detected conditions or events.

The data processing system 114 can determine, subsequent to deployment of the canopy, that an air pressure of the tubular structure is less than a threshold for a predetermined duration of time. For example, the air pressure of the tubular structure can fall below a threshold if there is a leak in the tubular structure, a valve is stuck open, or the air compressor is malfunctioning or not capable of sufficiently inflating the tubular structure. The duration of time can correspond to an amount of time to inflate the tubular structure to a desired pressure, such as 5 minutes, 10 minutes, 15 minutes or 20 minutes. The data processing system 114 can determine, responsive to the air pressure of the tubular structure falling below the predetermined pressure threshold for the duration of time, to retract the canopy. For example, the data processing system 114 can determine that due to the leak in the tubular structure, that it is not possible to sufficiently deploy or inflate the canopy, and, therefore, to retract and store the canopy in the container. The data processing system 114 can provide an indication or alert to a remote server or computing device of a user of the object that the canopy was retracted and stored due to low pressure.

Figure 7:
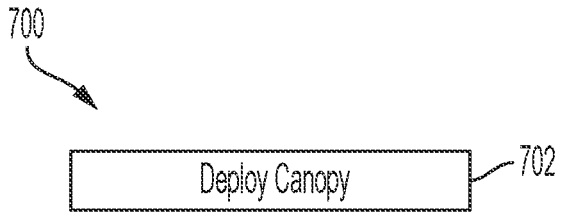
FIG. 7 depicts a method for deploying a canopy with a deployable structure.

FIG. 7 depicts a method 700 of deploying a canopy with a deployable structure. The method 700 can be performed by one or more system or component depicted in FIG. 1-6, 10 or 11, including, for example, a canopy, tubular structure, fabric or data processing system. At ACT 702, the method 700 can include deploying a canopy. The canopy can include a tubular structure. The canopy can be deployed by inflating the tubular structure. For example, to deploy the canopy, an air compressor can fill an interior of the tubular structure with air or a gas. When inflated, the tubular structure can extend. The a fabric can be coupled (e.g., stitched) to the tubular structure such that when the tubular structure is inflated, the tubular structure extends the fabric. During deployment, the canopy can extend the fabric over at least a portion of an object. For example, the object can include a vehicle, a boat, a tent, or other type of object.

Prior to deployment, the canopy can be stored in a container. For example, the canopy can be stored in a container that is attached to the object. The container can be located on a top portion, roof, or ceiling of the object.

The method can include a data processing system of a vehicle receiving, via network, a first indication to deploy the canopy. For example, a user can interact with a remote control or mobile application to generate an instruction or command to deploy the canopy. The remote control or mobile application can transmit the instruction directly to the data processing system of the vehicle (e.g., via a wireless signal). In another example, a remote server can monitor the weather forecast for a geographic area at which the vehicle is located, and automatically determine to deploy the canopy responsive to the temperature or precipitation forecasted for the geographic area. The remote control or mobile application can transmit the instruction to a remote server, which in turn can transmit an instruction or command to the data processing system of the vehicle. The data processing system of the vehicle can cause, responsive to the first indication to deploy the canopy, an air compressor of the vehicle to inflate the tubular structure to a predetermined pressure. The data processing system can receive, via the network, a second indication to retract the canopy. The data processing system can cause, responsive to the second indication to retract the canopy, the tubular structure to deflate and retract into a container for storage.

The method can include the data processing system receiving data from a sensor of the vehicle. For example, the sensor can be a temperature sensor, solar radiation sensor, or rain gauge. The data processing system can detect, based on the data from the sensor, a condition (e.g., temperature above a threshold, solar radiation above a threshold, or precipitation above a threshold). The data processing system can determine, responsive to the condition detected based on the data, to deploy the canopy over the vehicle. The data processing system can provide, responsive to the determination to deploy the canopy, a command to an air compressor of the vehicle to cause the air compressor to inflate the tubular structure.

Figure 8:
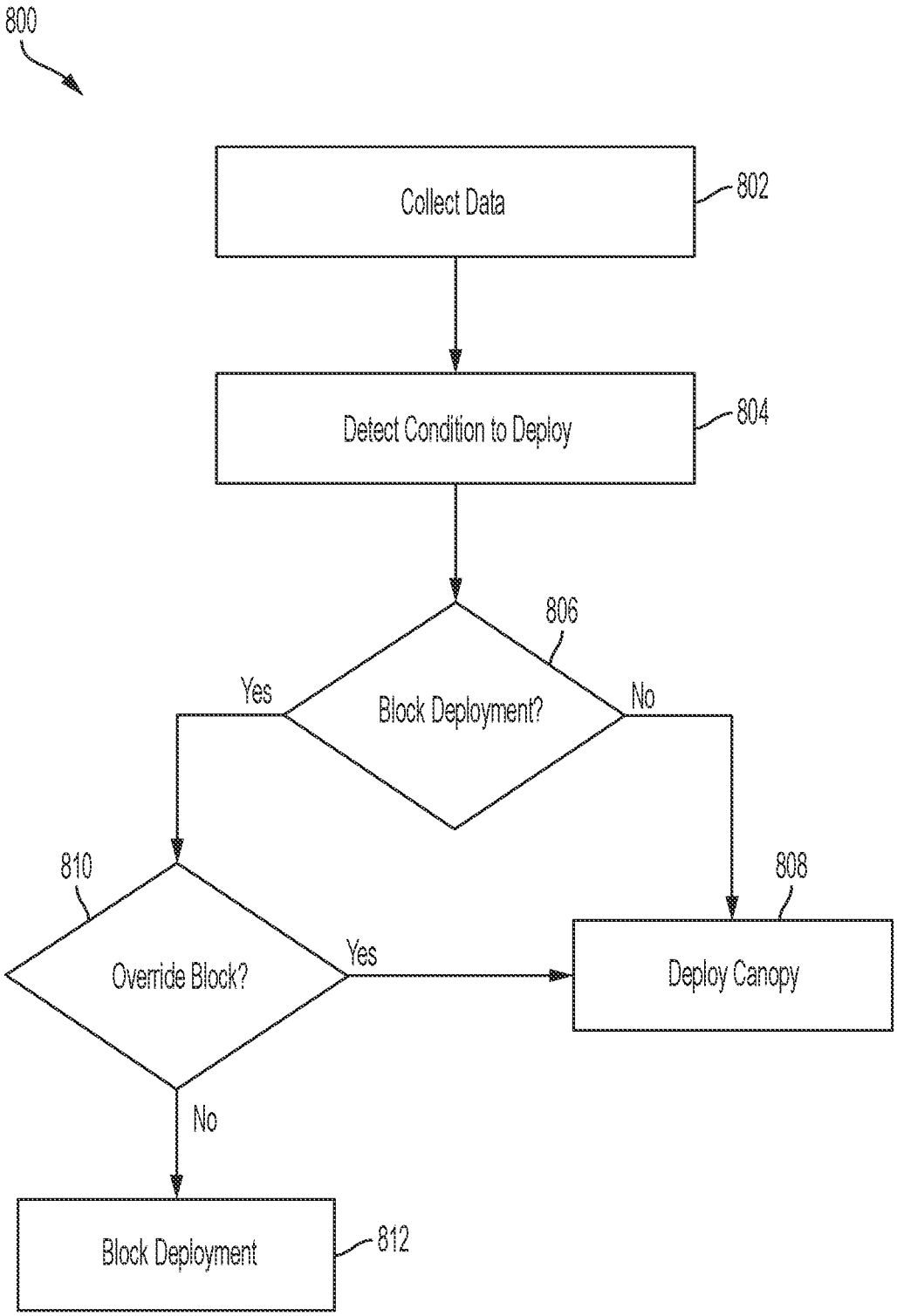
FIG. 8 depicts a method for deploying a canopy with a deployable structure.

FIG. 8 depicts a method 800 for deploying a canopy with a deployable structure. The method 800 can be performed by one or more system or component depicted in FIG. 1-6, 10 or 11, including, for example, a canopy, tubular structure, fabric or data processing system. At ACT 802, the method can include a data processing system collecting data. The data processing system can collect data from one or more sensors associated with or located on an object. The data processing system can collect data from one or more data sources that are remote from the data processing system. For example, the data processing system can be part of, or located on, an object such as a vehicle or a boat. The data processing system can receive data from a remote server, such as a weather resource. The data processing system can receive data from sensors located on the vehicle or boat, such as a temperature sensor, rain sensor, or solar radiation sensor. The data processing system can receive data from a proximity sensor, occupancy sensor, or obstacle sensor.

At ACT 804, the data processing system can detect a condition to deploy a canopy. Conditions can be based on, for example, temperature, solar radiation, wind, precipitation, or user instruction or command. The data processing system can detect a condition to deploy a canopy based on a comparison of data collected at ACT 802 with thresholds stored in a data repository of the data processing system. For example, the data processing system can detect a condition to deploy the canopy based on a comparison of a temperature of the cabin of the vehicle with a temperature threshold, such as 90 degrees Fahrenheit.

Upon detecting a condition to deploy the canopy at ACT 804, the data processing system can proceed to decision block 806 to determine whether to block deployment of the canopy. For example, the data processing system can determine to deploy the canopy passed on the temperature of the cabin exceeding a temperature threshold, but before deploying the canopy, the data processing system can determine whether there are any second conditions present that cause the data processing system to block deployment of the canopy. The data processing system can determine to block deployment of the canopy based on detecting an obstacle being present that can affect deployment of the canopy, based on occupancy of the cabin of the vehicle or boat, based on wind speed exceeding a wind speed threshold, or based on the vehicle moving. If the data processing system determines that it is able to deploy the canopy (e.g., determines not to block deployment), then the data processing system can proceed to ACT 808 to deploy the canopy.

If, however, the data processing system determines at decision block 806 to block deployment of the canopy, then the data processing system can proceed to decision block 810 to determine whether to override the decision to block. The data processing system can override the decision to block deployment of the canopy based on a third condition. For example, the data processing system can provide a prompt at decision block 806 for user input as to whether to override the blocked deployment. A user can respond to the prompt with an indication to proceed with deployment irrespective of the decision at decision block 806 to block deployment. The user can provide the override via a mobile device, computing device, remote application, remote control, or user interface of the vehicle. Thus, a user can override the decision made by the data processing system to block deployment.

In another example, the data processing system can determine, at decision block 810, to override the decision to block deployment at decision block 806 based on the temperature of the cabin exceeding a second temperature threshold, based on a solar radiation exceeding a second threshold, or other factors. The second threshold can be greater than the first threshold used to determine to detect the condition to deploy the canopy at ACT 804.

In another example, the data processing system can determine to override the blocked deployment at decision block 810 if the second condition, which caused the data processing system to determine to block deployment at decision block 806, is no longer present, has been removed or otherwise eliminated by the time the data processing system proceeds to decision block 810. For example, the data processing system may have determined to block deployment at decision block 806 due to an obstacle, occupancy, or a wind speed greater than a threshold. The data processing system can proceed to decision block 810 to determine whether the obstacle is still present, the vehicle is still occupied, or the wind speed is still greater than the threshold. If the data processing system determines that the obstacle has been removed, the vehicle is no longer occupied, or the wind speed is less than the threshold, then the data processing system can proceed to ACT 808 to override the decision to block deploy and continue with deploying the canopy. If, however, the data processing system determines to maintain the block in order to prevent deployment of the canopy, then the data processing system can proceed to ACT 812 to block deployment of the canopy.

At ACT 812, the data processing system can block deployment of the canopy. For example, the data processing system can prevent deployment or otherwise not activate an air compressor to inflate the tubular structure. The data processing system can return to ACT 802 to collect additional data and detect additional conditions to deploy. At ACT 808, the data processing system can deploy the canopy by activating an air compressor to inflate the tubular structure and extent the canopy.

Figure 9:
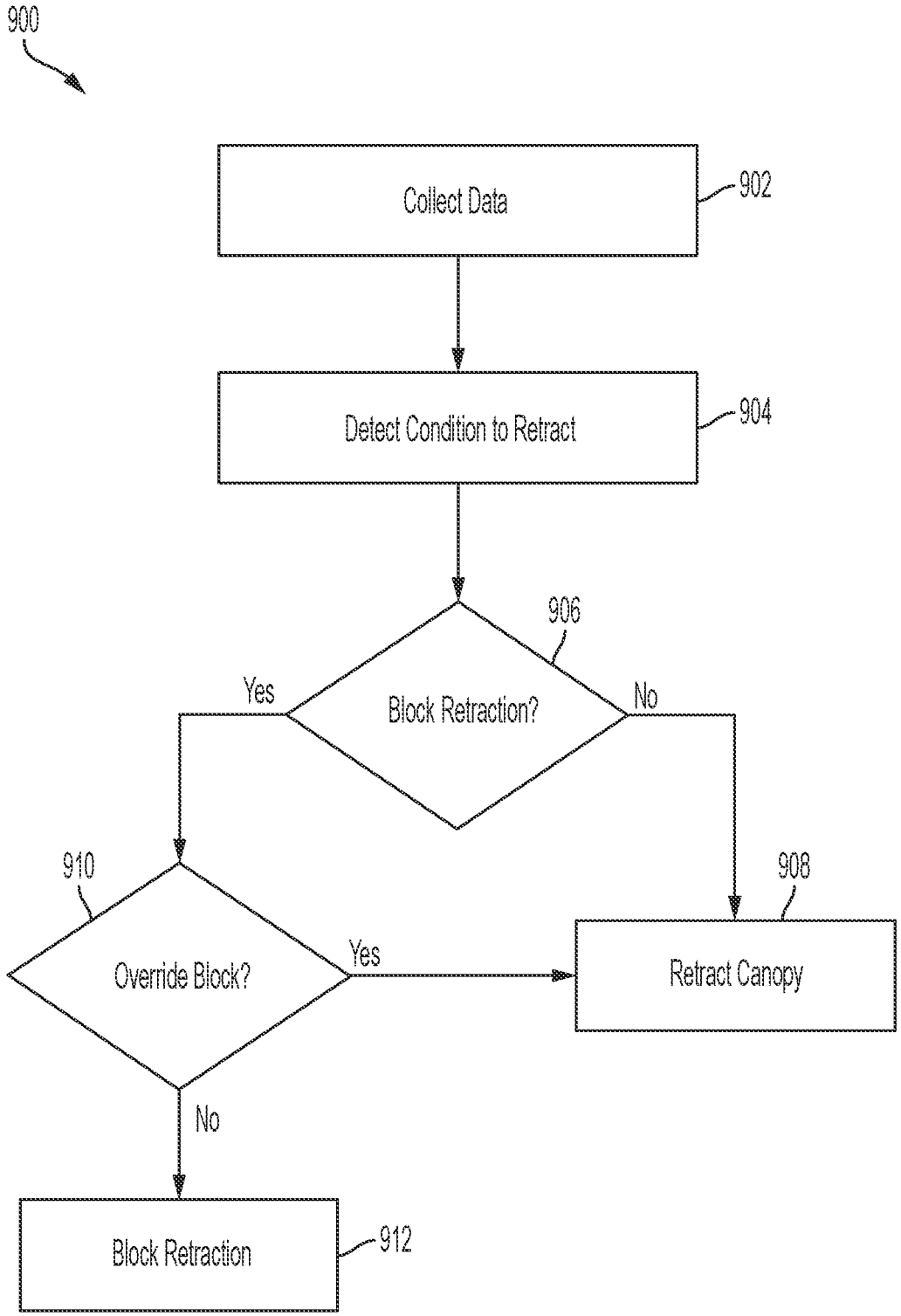
FIG. 9 depicts a method for retracting a canopy with a deployable structure.

FIG. 9 depicts a method 900 for retracting a canopy with a deployable structure. The method 900 can be performed by one or more system or component depicted in FIG. 1-6, 10 or 11, including, for example, a canopy, tubular structure, fabric or data processing system. At ACT 902, the method can include a data processing system collecting data. The data processing system can collect data from one or more sensors associated with or located on an object. The data processing system can collect data from one or more data sources that are remote from the data processing system. For example, the data processing system can be part of, or located on, an object such as a vehicle or a boat. The data processing system can receive data from a remote server, such as a weather resource. The data processing system can receive data from sensors located on the vehicle or boat, such as a temperature sensor, rain sensor, or solar radiation sensor. The data processing system can receive data from a proximity sensor, occupancy sensor, or obstacle sensor.

At ACT 904, the data processing system can detect a condition to retract a canopy. Conditions can be based on, for example, temperature, solar radiation, wind, precipitation, or user instruction or command. The data processing system can detect a condition to retract a canopy based on a comparison of data collected at ACT 902 with thresholds stored in a data repository of the data processing system. For example, the data processing system can detect a condition to retract the canopy based on a comparison of a temperature of the cabin of the vehicle with a temperature threshold, such as 60 degrees Fahrenheit. The data processing system can detect a condition to retract the canopy based on a temperature of the environment in which the vehicle is located. For example, if the outside temperature or temperature external to the object or vehicle is less than 0 degrees Fahrenheit, the data processing system can determine to retract the canopy to prevent damage to the canopy from occurring. In some cases, the data processing system can determine to retract the canopy if the wind speed is greater than 50 miles per hour. In some cases, the data processing system can determine to retract the canopy if the conditions under which the canopy was deployed are no longer present (e.g., no more sunlight). In some cases, the data processing system can determine to retract the canopy responsive to a user unlocking the doors of the vehicle.

Upon detecting a condition to retract the canopy at ACT 904, the data processing system can proceed to decision block 906 to determine whether to block retraction of the canopy. For example, the data processing system can determine to retract the canopy passed on the temperature of the cabin falling below a temperature threshold or the rain stopping, but before retracting the canopy, the data processing system can determine whether there are any second conditions present that cause the data processing system to block retraction of the canopy. The data processing system can determine to block retraction of the canopy based on detecting an obstacle being present that can affect retraction of the canopy, based on a user being near the vehicle (e.g., within 2 feet of the vehicle), based on a forecast of further rain or precipitation to occur within 1 hour. If the data processing system determines that it is able to retract the canopy (e.g., determines not to block retract), then the data processing system can proceed to ACT 908 to retract the canopy.

If, however, the data processing system determines at decision block 906 to block retraction of the canopy, then the data processing system can proceed to decision block 910 to determine whether to override the decision to block retraction. The data processing system can override the decision to block retraction of the canopy based on a third condition. For example, the data processing system can provide a prompt at decision block 906 for user input as to whether to override the blocked retraction. A user can respond to the prompt with an indication to proceed with retraction irrespective of the decision at decision block 906 to block retraction. The user can provide the override via a mobile device, computing device, remote application, remote control, or user interface of the vehicle. Thus, a user can override the decision made by the data processing system to block retraction.

In another example, the data processing system can determine, at decision block 910, to override the decision to block retraction at decision block 906 based on the temperature of the cabin being less than a second temperature threshold, based on a solar radiation being less than a second threshold, or other factors. The second threshold can be less than the first threshold used to determine to detect the condition to retract the canopy at ACT 904.

In another example, the data processing system can determine to override the blocked retraction at decision block 910 if the second condition, which caused the data processing system to determine to block retraction at decision block 906, is no longer present, has been removed or otherwise eliminated by the time the data processing system proceeds to decision block 910. For example, the data processing system may have determined to block retraction at decision block 906 due to an obstacle, proximity of user to the vehicle (e.g., within 2 feet), or a wind speed less than a threshold. The data processing system can proceed to decision block 910 to determine whether the obstacle is still present, the user is still proximate to the vehicle (e.g., within 2 feet), or the wind speed is still less than the threshold. If the data processing system determines that the obstacle has been removed, the user is no longer proximate to the vehicle, or the wind speed is greater than the threshold, then the data processing system can proceed to ACT 908 to override the decision to block retraction and continue with retracting the canopy. If, however, the data processing system determines to maintain the block in order to prevent retraction of the canopy, then the data processing system can proceed to ACT 912 to block retraction of the canopy.

At ACT 912, the data processing system can block retraction of the canopy. For example, the data processing system can prevent retraction or otherwise activate an air compressor to maintain air pressure of the tubular structure. The data processing system can return to ACT 902 to collect additional data and detect additional conditions to retract the canopy. At ACT 908, the data processing system can retract the canopy by activating a release valve to release the air or gas in the tubular structure.

Figure 10:
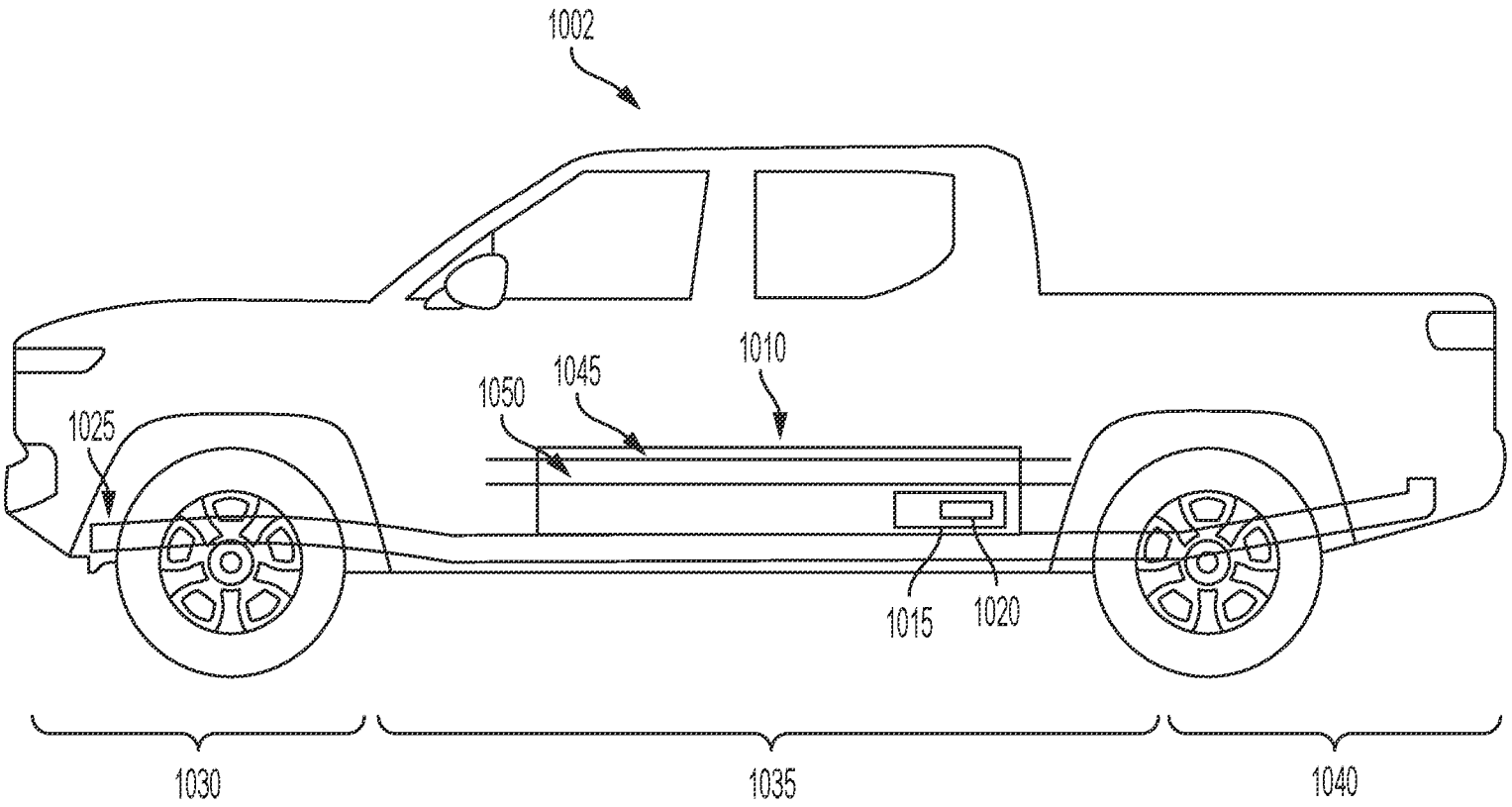
FIG. 10 depicts an electric vehicle.

FIG. 10 depicts an example cross-sectional view of an electric vehicle 1002 installed with at least one battery pack 1010. Electric vehicles 1002 can include electric trucks, electric sport utility vehicles (SUVs), electric delivery vans, electric automobiles, electric cars, electric motorcycles, electric scooters, electric passenger vehicles, electric passenger or commercial trucks, hybrid vehicles, or other vehicles such as sea or air transport vehicles, planes, helicopters, submarines, boats, or drones, among other possibilities. The battery pack 1010 can also be used as an energy storage system to power a building, such as a residential home or commercial building. Electric vehicles 1002 can be fully electric or partially electric (e.g., plug-in hybrid) and further, electric vehicles 1002 can be fully autonomous, partially autonomous, or unmanned. Electric vehicles 1002 can also be human operated or non-autonomous. Electric vehicles 1002 such as electric trucks or automobiles can include on-board battery packs 1010, batteries 1015 or battery modules 1015, or battery cells 1020 to power the electric vehicles. The electric vehicle 1002 can include a chassis 1025 (e.g., a frame, internal frame, or support structure). The chassis 1025 can support various components of the electric vehicle 1002. The chassis 1025 can span a front portion 1030 (e.g., a hood or bonnet portion), a body portion 1035, and a rear portion 1040 (e.g., a trunk, payload, or boot portion) of the electric vehicle 1002. The battery pack 1010 can be installed or placed within the electric vehicle 1002. For example, the battery pack 1010 can be installed on the chassis 1025 of the electric vehicle 1002 within one or more of the front portion 1030, the body portion 1035, or the rear portion 1040. The battery pack 1010 can include or connect with at least one busbar, e.g., a current collector element. For example, the first busbar 1045 and the second busbar 1050 can include electrically conductive material to connect or otherwise electrically couple the battery 1015, the battery modules 1015, or the battery cells 1020 with other electrical components of the electric vehicle 1002 to provide electrical power to various systems or components of the electric vehicle 1002.

Figure 11:
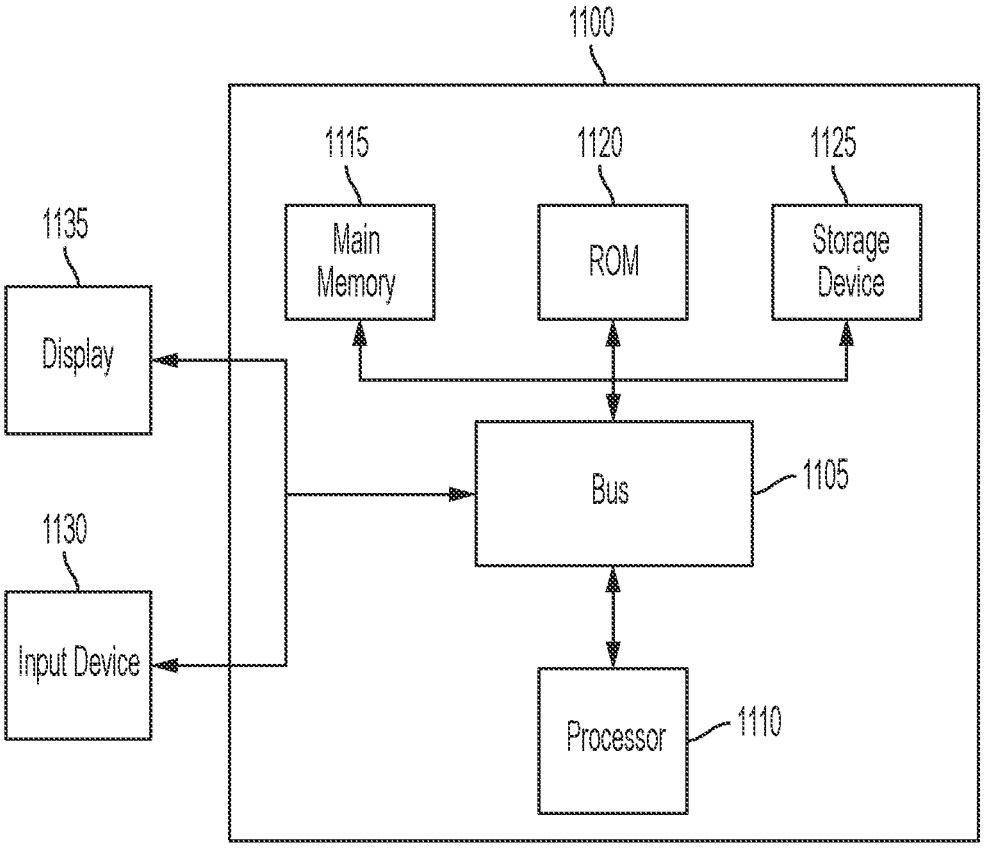
FIG. 11 is a block diagram illustrating an architecture for a computer system that can be employed to implement elements of the systems and methods described and illustrated herein, including, for example, the system depicted in FIG. 6 and the methods depicted in FIG. 7 and FIG. 8.

FIG. 11 depicts an example block diagram of an example computer system 1100. The computer system or computing device 1100 can include or be used to implement a data processing system or its components. The computing system 1100 includes at least one bus 1105 or other communication component for communicating information and at least one processor 1110 or processing circuit coupled to the bus 1105 for processing information. The computing system 1100 can also include one or more processors 1110 or processing circuits coupled to the bus for processing information. The computing system 1100 also includes at least one main memory 1115, such as a random access memory (RAM) or other dynamic storage device, coupled to the bus 1105 for storing information, and instructions to be executed by the processor 1110. The main memory 1115 can be used for storing information during execution of instructions by the processor 1110. The computing system 1100 may further include at least one read only memory (ROM) 1120 or other static storage device coupled to the bus 1105 for storing static information and instructions for the processor 1110. A storage device 1125, such as a solid state device, magnetic disk or optical disk, can be coupled to the bus 1105 to persistently store information and instructions.

The computing system 1100 may be coupled via the bus 1105 to a display 1135, such as a liquid crystal display, or active matrix display, for displaying information to a user such as a driver of the electric vehicle 1002 or other end user. An input device 1130, such as a keyboard or voice interface may be coupled to the bus 1105 for communicating information and commands to the processor 1110. The input device 1130 can include a touch screen display 1135. The input device 1130 can also include a cursor control, such as a mouse, a trackball, or cursor direction keys, for communicating direction information and command selections to the processor 1110 and for controlling cursor movement on the display 1135.

The processes, systems and methods described herein can be implemented by the computing system 1100 in response to the processor 1110 executing an arrangement of instructions contained in main memory 1115. Such instructions can be read into main memory 1115 from another computer-readable medium, such as the storage device 1125. Execution of the arrangement of instructions contained in main memory 1115 causes the computing system 1100 to perform the illustrative processes described herein. One or more processors in a multi-processing arrangement may also be employed to execute the instructions contained in main memory 1115. Hard-wired circuitry can be used in place of or in combination with software instructions together with the systems and methods described herein. Systems and methods described herein are not limited to any specific combination of hardware circuitry and software.

Although an example computing system has been described in FIG. 11, the subject matter including the operations described in this specification can be implemented in other types of digital electronic circuitry, or in computer software, firmware, or hardware, including the structures disclosed in this specification and their structural equivalents, or in combinations of one or more of them.

Some of the description herein emphasizes the structural independence of the aspects of the system components or groupings of operations and responsibilities of these system components. Other groupings that execute similar overall operations are within the scope of the present application. Modules can be implemented in hardware or as computer instructions on a non-transient computer readable storage medium, and modules can be distributed across various hardware or computer based components.

The systems described above can provide multiple ones of any or each of those components and these components can be provided on either a standalone system or on multiple instantiation in a distributed system. In addition, the systems and methods described above can be provided as one or more computer-readable programs or executable instructions embodied on or in one or more articles of manufacture. The article of manufacture can be cloud storage, a hard disk, a CD-ROM, a flash memory card, a PROM, a RAM, a ROM, or a magnetic tape. In general, the computer-readable programs can be implemented in any programming language, such as LISP, PERL, C, C++, C#, PROLOG, or in any byte code language such as JAVA. The software programs or executable instructions can be stored on or in one or more articles of manufacture as object code.

Example and non-limiting module implementation elements include sensors providing any value determined herein, sensors providing any value that is a precursor to a value determined herein, datalink or network hardware including communication chips, oscillating crystals, communication links, cables, twisted pair wiring, coaxial wiring, shielded wiring, transmitters, receivers, or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), or digital control elements.

The subject matter and the operations described in this specification can be implemented in digital electronic circuitry, or in computer software, firmware, or hardware, including the structures disclosed in this specification and their structural equivalents, or in combinations of one or more of them. The subject matter described in this specification can be implemented as one or more computer programs, e.g., one or more circuits of computer program instructions, encoded on one or more computer storage media for execution by, or to control the operation of, data processing apparatuses. Alternatively or in addition, the program instructions can be encoded on an artificially generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. While a computer storage medium is not a propagated signal, a computer storage medium can be a source or destination of computer program instructions encoded in an artificially generated propagated signal. The computer storage medium can also be, or be included in, one or more separate components or media (e.g., multiple CDs, disks, or other storage devices include cloud storage). The operations described in this specification can be implemented as operations performed by a data processing apparatus on data stored on one or more computer-readable storage devices or received from other sources.

The terms "computing device", "component" or "data processing apparatus" or the like encompass various apparatuses, devices, and machines for processing data, including by way of example a programmable processor, a computer, a system on a chip, or multiple ones, or combinations of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, app, script, or code) can be written in any form of programming language, including compiled or interpreted languages, declarative or procedural languages, and can be deployed in any form, including as a stand-alone program or as a module, component, subroutine, object, or other unit suitable for use in a computing environment. A computer program can correspond to a file in a file system. A computer program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatuses can also be implemented as, special purpose logic circuitry, e.g., an FPGA (field programmable gate array) or an ASIC (application specific integrated circuit). Devices suitable for storing computer program instructions and data can include non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The subject matter described herein can be implemented in a computing system that includes a back end component, e.g., as a data server, or that includes a middleware component, e.g., an application server, or that includes a front end component, e.g., a client computer having a graphical user interface or a web browser through which a user can interact with an implementation of the subject matter described in this specification, or a combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While operations are depicted in the drawings in a particular order, such operations are not required to be performed in the particular order shown or in sequential order, and all illustrated operations are not required to be performed. Actions described herein can be performed in a different order.

Having now described some illustrative implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements and features discussed in connection with one implementation are not intended to be excluded from a similar role in other implementations or implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular may also embrace implementations including a plurality of these elements, and any references in plural to any implementation or element or act herein may also embrace implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation or embodiment, and references to "an implementation," "some implementations," "one implementation" or the like are not necessarily mutually exclusive and are intended to indicate that a particular feature, structure, or characteristic described in connection with the implementation may be included in at least one implementation or embodiment. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

Relative parallel, perpendicular, vertical or other positioning or orientation descriptions include variations within +/−10% or +/−10 degrees of pure vertical, parallel or perpendicular positioning. References to "approximately," "substantially" or other terms of degree include variations of +/−10% from the given measurement, unit, or range unless explicitly indicated otherwise. Coupled elements can be electrically, mechanically, or physically coupled with one another directly or with intervening elements. Scope of the systems and methods described herein is thus indicated by the appended claims, rather than the foregoing description, and changes that come within the meaning and range of equivalency of the claims are embraced therein.

What is claimed is:

1. An apparatus, comprising:

a canopy comprising a structure configured to deploy over at least one portion of an object; and a fabric coupled to the structure, the structure configured to:

deploy the fabric over the at least one portion of the object; and subsequent to deployment of the fabric, retract the fabric responsive to a determination that an air pressure of the structure is less than a threshold for a predetermined duration of time.

2. The apparatus of claim 1, wherein the object comprises a vehicle, and the apparatus comprises:

the structure further configured to deploy the fabric over the at least one portion of the vehicle.

3. The apparatus of claim 1, comprising:

a container configured to:

store the canopy; and deploy the canopy over the at least one portion of the object.

4. The apparatus of claim 1, wherein the structure further comprises a tubular structure comprising:

a plurality of tubes coupled to the fabric, the plurality of tubes configured to extend the fabric responsive to inflation; and a pocket that houses a spring steel configured to cause the tubular structure to retract into a container configured to store the canopy responsive to a pressure within the tubular structure less than a second threshold.

5. The apparatus of claim 1, wherein the object comprises a vehicle, and the apparatus comprises:

an air compressor, located in the vehicle, configured to:

deploy, via inflation and from a container that stores the canopy, the structure to extend the fabric to at least partially cover the vehicle.

6. The apparatus of claim 1, wherein the object comprises a vehicle, and the apparatus comprises:

a container, coupled to a roof of the vehicle, to store the canopy, wherein at least a portion of the container is separated from a portion of the canopy upon deployment of the canopy to create an air gap to allow air flow between the canopy and the vehicle.

7. The apparatus of claim 1, comprising:

the canopy configured to deploy to form an awning on at least one side of the object, the awning supported by one or more support structures that couple to one or more tubes of the structure of the canopy; and a component of the canopy configured to couple a tube of the structure to a portion of the object.

8. The apparatus of claim 1, comprising:

the structure configured to deploy the fabric over the at least one portion of the object responsive to a temperature of or detected within the object being greater than or equal to a second threshold.

9. A system, comprising:

a container to couple with a vehicle, the container configured to:

store a canopy comprising a fabric and a deployable structure coupled to the fabric; and open to deploy the canopy over at least a portion of the vehicle via extension of the fabric by the deployable structure; and one or more processors to:

determine, subsequent to deployment of the canopy, that an air pressure of the deployable structure is less than a threshold for a predetermined duration of time; and retract the canopy responsive to the determination that the air pressure of the deployable structure is less than the threshold for the predetermined duration of time.

10. The system of claim 9, comprising:

an air compressor, located in the vehicle, configured to inflate the deployable structure to deploy the canopy from the container to at least partially cover the vehicle.

11. The system of claim 9, comprising:

the one or more processors to:

receive, via a network, a first indication to deploy the canopy;

cause, responsive to the first indication to deploy the canopy, an air compressor of the vehicle to inflate the deployable structure to a predetermined pressure;

receive, via the network, a second indication to retract the canopy; and cause, responsive to the second indication to retract the canopy, the deployable structure to deflate and retract into the container for storage.

12. The system of claim 9, comprising:

one or more sensors; and the one or more processors to:

receive data from the one or more sensors;

detect, based on the data from the one or more sensors, a condition;

determine, responsive to the condition detected based on the data, to deploy the canopy; and provide, responsive to the determination to deploy the canopy, a command to an air compressor of the vehicle to cause the air compressor to inflate the deployable structure.

13. The system of claim 9, comprising:

the one or more processors to:

determine a location of the vehicle;

request, via a network, weather information for the location;

determine, based on the weather information, to deploy the canopy; and cause the canopy to deploy from the container configured to store the canopy responsive to the determination based on the weather information.

14. The system of claim 9, comprising:

the one or more processors to:

receive, via a network, an instruction to deploy the canopy;

determine, responsive to receipt of the instruction to deploy the canopy, a wind speed or a speed of the vehicle; and determine, based on the wind speed or the speed of the vehicle, to prevent deployment of the canopy.

15. The system of claim 9, comprising:

the one or more processors to:

receive an indication to deploy the canopy;

determine, based on a first condition associated with the vehicle, to prevent deployment of the canopy;

determine, based on a second condition associated with the vehicle, to override the determination to prevent deployment of the canopy; and deploy, responsive to the determination to override, the canopy.

16. The system of claim 9, comprising:

the one or more processors to:

detect, via a sensor, a temperature within a cabin of the vehicle;

determine, based on the temperature greater than or equal to a second threshold, to deploy the canopy; and cause the canopy to deploy from the container configured to store the canopy responsive to the determination.

17. A method, comprising:

deploying, by one or more processors of a vehicle, a canopy comprising a structure over at least one portion of the vehicle to extend a fabric coupled to the structure over the at least one portion of the vehicle;

determining, by the one or more processors subsequent to deployment of the canopy, that an air pressure of the structure is less than a threshold for a predetermined duration of time; and retracting, by the one or more processors, the canopy responsive to the determination that the air pressure of the structure is less than the threshold for the predetermined duration of time.

18. The method of claim 17, comprising:

storing, prior to the deploying, the canopy in a container.

19. The method of claim 17, comprising:

receiving, by the one or more processors of the vehicle via a network, a first indication to deploy the canopy;

causing, by the one or more processors responsive to the first indication to deploy the canopy, an air compressor of the vehicle to inflate the structure to a predetermined pressure;

receiving, by the one or more processors via the network, a second indication to retract the canopy; and causing, by the one or more processors responsive to the second indication to retract the canopy, the structure to deflate and retract into a container for storage.

20. The method of claim 17, comprising:

receiving, by the one or more processors, data from a sensor of the vehicle;

detecting, by the one or more processors based on the data from the sensor, a condition;

determining, by the one or more processors responsive to the condition detected based on the data, to deploy the canopy over the vehicle; and providing, by the one or more processors responsive to the determination to deploy the canopy, a command to an air compressor of the vehicle to cause the air compressor to inflate the structure.

* * * * *